US009593653B2

(12) United States Patent
Pursifull et al.

(10) Patent No.: US 9,593,653 B2
(45) Date of Patent: Mar. 14, 2017

(54) DIRECT INJECTION FUEL PUMP SYSTEM

(71) Applicant: Ford Global Technologies, LLC, Dearborn, MI (US)

(72) Inventors: Ross Dykstra Pursifull, Dearborn, MI (US); Brad Alan VanDerWege, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 107 days.

(21) Appl. No.: 14/601,967

(22) Filed: Jan. 21, 2015

(65) Prior Publication Data

US 2016/0208757 A1 Jul. 21, 2016

(51) Int. Cl.

| | |
|---|---|
| ***F02M 59/02*** | (2006.01) |
| ***F04B 19/22*** | (2006.01) |
| ***F04B 11/00*** | (2006.01) |
| ***F04B 53/10*** | (2006.01) |
| ***F04B 53/14*** | (2006.01) |
| ***F04B 53/16*** | (2006.01) |
| ***F02M 63/00*** | (2006.01) |
| ***F02M 63/02*** | (2006.01) |

(Continued)

(52) U.S. Cl.

CPC ..... *F02M 59/022* (2013.01); *F02M 55/02* (2013.01); *F02M 59/102* (2013.01); *F02M 63/0001* (2013.01); *F02M 63/029* (2013.01); *F04B 11/0033* (2013.01); *F04B 19/22* (2013.01); *F04B 53/10* (2013.01); *F04B 53/14* (2013.01); *F04B 53/16* (2013.01); *F02M 55/025* (2013.01); *F02M 2200/02* (2013.01); *F02M 2200/09* (2013.01)

(58) Field of Classification Search

CPC .... F02M 59/022; F02M 55/025; F04B 53/10; F04B 53/14; F04B 19/22; F04B 53/16; F04B 11/0033

USPC ..... 123/294

See application file for complete search history.

(56) References Cited

U.S. PATENT DOCUMENTS 4,422,424 A * 12/1983 Luscomb ..... F02M 59/32 123/447

4,738,595 A 4/1988 Gaiser (Continued)

FOREIGN PATENT DOCUMENTS

EP 1582740 A1 10/2005

WO 2011104052 A2 9/2011

OTHER PUBLICATIONS

Stickler, Mark L. et al., "Pressure Device to Reduce Ticking Noise During Engine Idling," U.S. Appl. No. 14/286,648, filed May 23, 2014, 58 pages.

(Continued)

*Primary Examiner* — Joseph Dallo

(74) *Attorney, Agent, or Firm* — James Dottavio; John D. Russell; B. Anna McCoy

(57) ABSTRACT

Systems and methods are provided for operating a direct injection fuel pump. One example system comprises an accumulator positioned within a bore of the direct injection fuel pump in a coaxial manner wherein the accumulator is positioned downstream from a solenoid activated check valve. The accumulator may regulate pressure in a compression chamber of the direct injection fuel pump and a high pressure fuel rail when the direct injection fuel pump is operating in a default pressure mode.

19 Claims, 12 Drawing Sheets

(51) Int. Cl.
*F02M 59/10* (2006.01)
*F02M 55/02* (2006.01)

(56) References Cited

U.S. PATENT DOCUMENTS 6,135,734 A * 10/2000 Isozumi ..... F02M 55/04 123/447
6,536,416 B1 * 3/2003 Mahr ..... F02M 45/00 123/447
6,626,148 B1 * 9/2003 Cooke ..... F04B 1/043 123/447
6,792,912 B2 * 9/2004 Kikuchi ..... F02D 37/02 123/294
6,899,085 B2 * 5/2005 Kelly ..... F02M 59/366 123/447
6,904,890 B2 * 6/2005 Maitani ..... F02D 41/062 123/294
7,610,902 B2 * 11/2009 Beardmore ..... F02M 59/44 123/467
7,647,918 B2 1/2010 Portner et al.
8,479,712 B2 * 7/2013 Nakane ..... F02M 37/0041 123/511
2013/0213359 A1 8/2013 Zeng et al.
2013/0213360 A1 8/2013 Zeng et al.
2013/0213361 A1 8/2013 Zeng et al.
2014/0003966 A1 1/2014 Zeng et al.
2014/0154100 A1 6/2014 Zeng et al.
2014/0224209 A1 * 8/2014 Pursifull ..... F02M 63/0001 123/294
2014/0224217 A1 8/2014 Pursifull et al.
2015/0027416 A1 1/2015 Brostrom et al.
2015/0075484 A1 3/2015 VanDerWege et al.

OTHER PUBLICATIONS

Surnilla, Gopichandra et al., "Methods and Systems for Fixed and Variable Pressure Fuel Injection," U.S. Appl. No. 14/570,546, filed Dec. 15, 2014, 51 pages.
Surnilla, Gopichandra et al., "Methods and Systems for Fixed and Variable Pressure Fuel Injection," U.S. Appl. No. 14/570,664, filed Dec. 15, 2014, 63 pages.
Pursifull, Ross D., "Method for Lift Pump Control," U.S. Appl. No. 14/558,482, filed Dec. 2, 2014, 53 pages.
Surnilla, Gopichandra et al., "High Pressure Fuel Pumps with Mechanical Pressure Regulation," U.S. Appl. No. 14/243,615, filed Apr. 2, 2014, 53 pages.
Surnilla, Gopichandra et al., "Robust Direct Injection Fuel Pump System," U.S. Appl. No. 14/155,250, filed Jan. 14, 2014, 61 pages.

* cited by examiner

DIRECT INJECTION FUEL PUMP SYSTEM

FIELD

The present application relates generally to a direct injection fuel pump in an internal combustion engine.

BACKGROUND AND SUMMARY

Port fuel direct injection (PFDI) engines include both port injection and direct injection of fuel and may advantageously utilize each injection mode. For example, at higher engine loads, fuel may be injected into the engine using direct fuel injection for improved engine performance (e.g., by increasing available torque and fuel economy). At lower engine loads and during engine starting, fuel may be injected into the engine using port fuel injection to provide improved fuel vaporization for enhanced mixing and to reduce engine emissions. Further, port fuel injection may provide an improvement in fuel economy over direct injection at lower engine loads. Further still, noise, vibration, and harshness (NVH) may be reduced when operating with port injection of fuel. In addition, both port injectors and direct injectors may be operated together under some conditions to leverage advantages of both types of fuel delivery or in some instances, differing fuels.

In PFDI engines, a lift pump (also termed, low pressure pump) supplies fuel from a fuel tank to both port fuel injectors and a direct injection fuel pump. The direct injection fuel pump may supply fuel at a higher pressure to direct injectors. Further, the direct injection (DI) fuel pump may be deactivated during certain periods of engine operation (e.g., during port fuel injection at low engine loads, engine idle conditions) which may affect lubrication of the DI fuel pump and increase wear, NVH, and degradation of the DI fuel pump.

One approach to reducing DI fuel pump degradation and improving lubrication may include continued direct injection of fuel into the engine at lower engine loads. In another example approach shown by Pursifull et al. in US 2014/0224209, the DI pump may be lubricated by maintaining a pressure difference between a top and a bottom of a piston in the DI pump. Herein, the DI fuel pump may be operated in a mechanical mode while direct fuel injection is reduced and/or discontinued. The pressure difference may be achieved by maintaining a compression chamber of the DI fuel pump at a default pressure wherein the default pressure is higher than an output pressure of the lift pump. The default pressure within the compression chamber may be obtained by deactivating the solenoid activated check valve enabling the solenoid activated check valve to operate in a pass-through state. Further, a pressure relief valve may be positioned upstream of the solenoid activated check valve to regulate fuel flow received from the compression chamber via the solenoid activated check valve during a compression stroke in the DI fuel pump. As such, the default pressure in the compression chamber of the DI fuel pump may be substantially equivalent to a pressure relief setting of the pressure relief valve.

The inventors herein have identified potential issues with the above approaches. For example, in the approach where direct injection is continued at lower engine loads, excessive NVH may be generated from ticks resulting from the actuation of the solenoid activated check valve in the DI fuel pump. These ticks may be audible to a vehicle operator and passengers due to a lack of engine noise to mask the DI fuel pump noise during engine operation at lower loads. Further, in the approach wherein the compression chamber in the DI fuel pump is maintained at default pressure by the pressure relief valve, fuel heating may occur due to repeated fuel flow through the pressure relief valve. Herein, the pressure relief valve provides a restriction to the fuel flow contributing to heating of the fuel. Furthermore, an increase in the temperature of the fuel may cause formation of fuel vapor, which can adversely affect pump lubrication. Further still, fuel heating may increase power consumption.

The inventors herein have recognized the above-mentioned issues and identified an approach to at least partly address the above issues. In one example approach, a system is provided comprising an accumulator positioned within a bore of a direct injection fuel pump in a coaxial manner, the accumulator positioned downstream from a solenoid activated check valve. The accumulator within the direct injection fuel pump may provide the default pressure to enable lubrication of the direct injection fuel pump during lower engine loads.

In another example approach, a method is provided comprising, when a solenoid activated check valve positioned upstream of an accumulator is de-energized and commanded to a pass-through state, regulating a pressure in a compression chamber of a direct injection fuel pump via axial motion of the accumulator, the accumulator positioned coaxially within a bore of the direct injection fuel pump.

For example, a DI fuel pump of a fuel system in a PFDI engine may include an accumulator positioned within a bore of the DI fuel pump. The accumulator may include a spring coupled to a piston. Further, the accumulator may be arranged downstream of an electronically controlled solenoid activated check valve. The DI fuel pump may be operated in one of two modes: a default pressure mode and a variable pressure mode. The solenoid activated inlet check valve may be activated, and maintained active, during the variable pressure mode. When the solenoid activated check valve is energized, it may regulate the fluid volume pumped into the direct injection fuel rail. Thus the solenoid activated check valve may be a fuel volume regulator. In other examples, the solenoid activated check valve may control pressure in the direct injection rail synchronously with a pump stroke in the DI fuel pump. When included in a closed loop pressure control system with a pressure sensor, the solenoid activated check valve may be an active element in a fuel rail pressure control system. In the default pressure mode, the solenoid activated inlet check valve may be deactivated to function in a pass-through state and the DI fuel pump may be operated with a default pressure. The default pressure mode may be activated during lower engine loads and engine idling conditions when direct injection into the chamber is reduced and/or disabled. The accumulator within the DI fuel pump bore may regulate pressure within the compression chamber, and the direct injection fuel rail, via axial motion of the piston of the accumulator. As such, the accumulator may store fuel at the default pressure through at least a portion of a compression stroke releasing the fuel into the direct injection fuel rail when fuel rail pressure decreases below the default pressure. A pressure relief valve may or may not be included in the DI fuel pump of the fuel system. By including the pressure relief valve, fuel heating after shutdown may be achieved.

In this way, a DI fuel pump may be operated during lower engine load conditions. By preserving a default pressure in the compression chamber via the accumulator, the DI fuel pump may be lubricated when fuel flow out of the direct injection fuel pump to fuel injectors is reduced and/or ceased. Specifically, an interface between a piston and a bore of the DI fuel pump may be lubricated. Since the DI fuel pump may be operated with a deactivated solenoid actuated check valve in the default pressure mode, a reduction in audible ticking noises and NVH may be provided. Further, by regulating pressure within the compression chamber via the accumulator in the default pressure mode, fuel heating due to repeated pump strokes may be diminished. By reducing a likelihood of fuel heating, vapor formation may be moderated. Furthermore, adverse effects of vapor formation on pump lubrication may be eased. Overall, durability of the DI fuel pump may be extended while simultaneously enhancing its performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

In port fuel direct injection (PFDI) engines, a fuel delivery system may include multiple fuel pumps for providing a desired fuel pressure to the fuel injectors. As one example, the fuel delivery system may include a lower pressure fuel pump (or lift pump) and a higher pressure (or direct injection) fuel pump arranged between a fuel tank and fuel injectors. The higher pressure fuel pump may be coupled to upstream of a high pressure fuel rail in a direct injection system to raise a pressure of the fuel delivered to engine cylinders through direct injectors. A solenoid activated inlet check valve, or spill valve, may be coupled upstream of the high pressure (HP) pump to regulate fuel flow into a compression chamber of the high pressure pump. The spill valve is commonly electronically controlled by a controller which may be part of a control system for the engine of the vehicle. Furthermore, the controller may also have a sensory input from a sensor, such as an angular position sensor, that allows the controller to command activation of the spill valve in synchronism with a driving cam that powers the high pressure pump.

Figure 1:
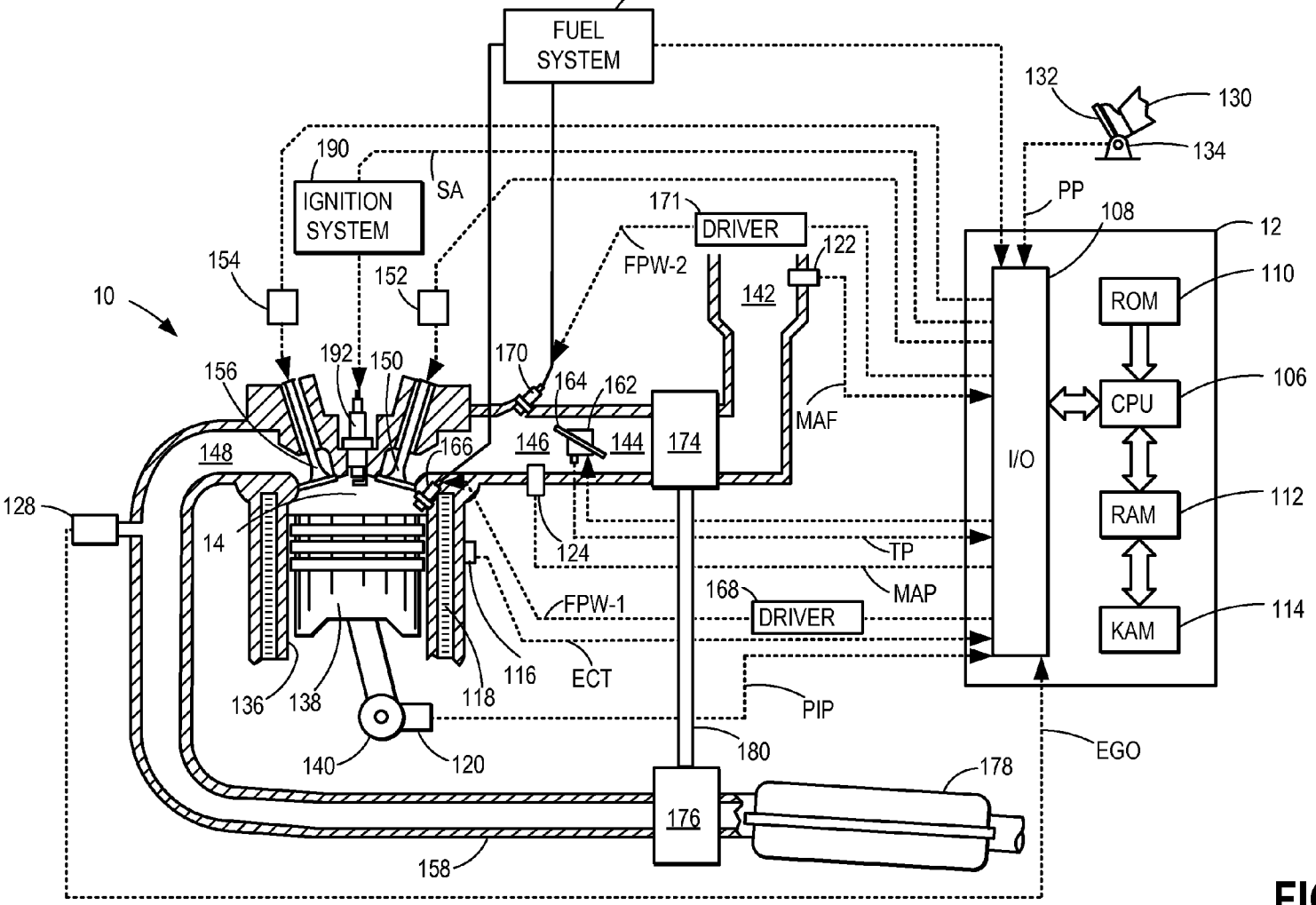
FIG. 1 shows an example of a cylinder of an internal combustion engine.
Figure 2:
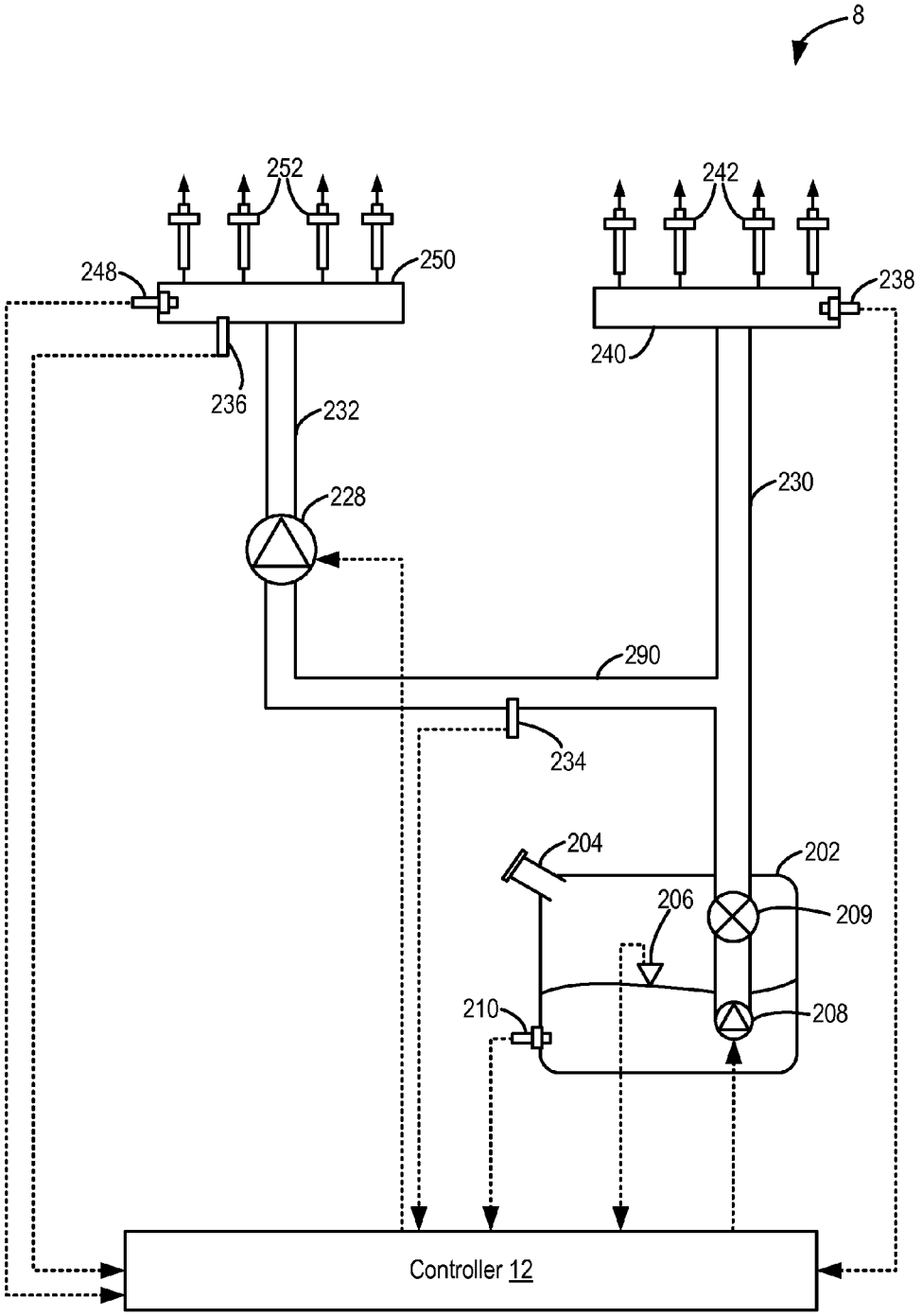
FIG. 2 schematically illustrates an example embodiment of a fuel system that may be used in the engine of FIG. 1.
Figure 3:
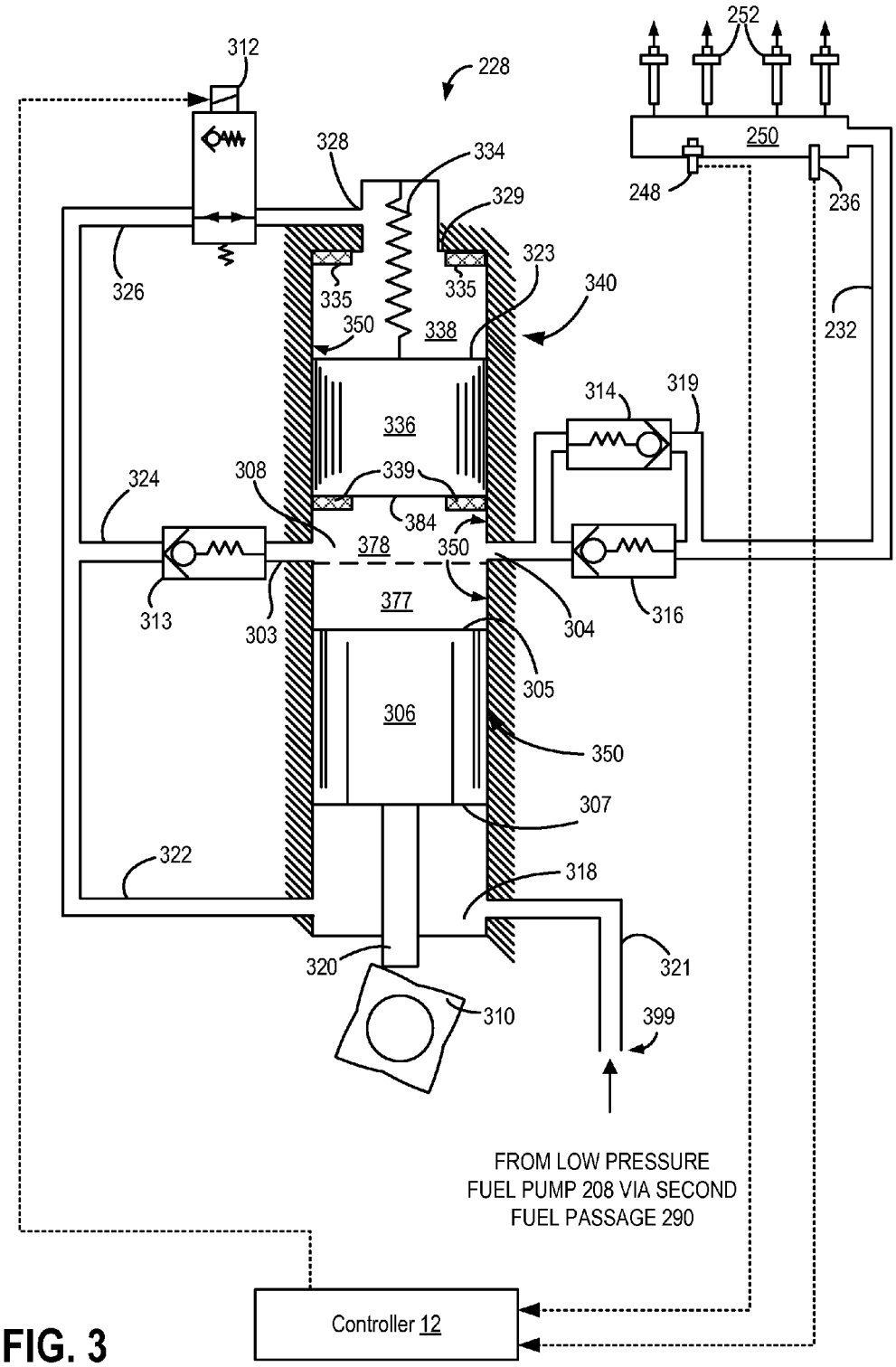
FIG. 3 presents an example embodiment of a high pressure or direct injection fuel pump according to the present disclosure.
Figure 5:
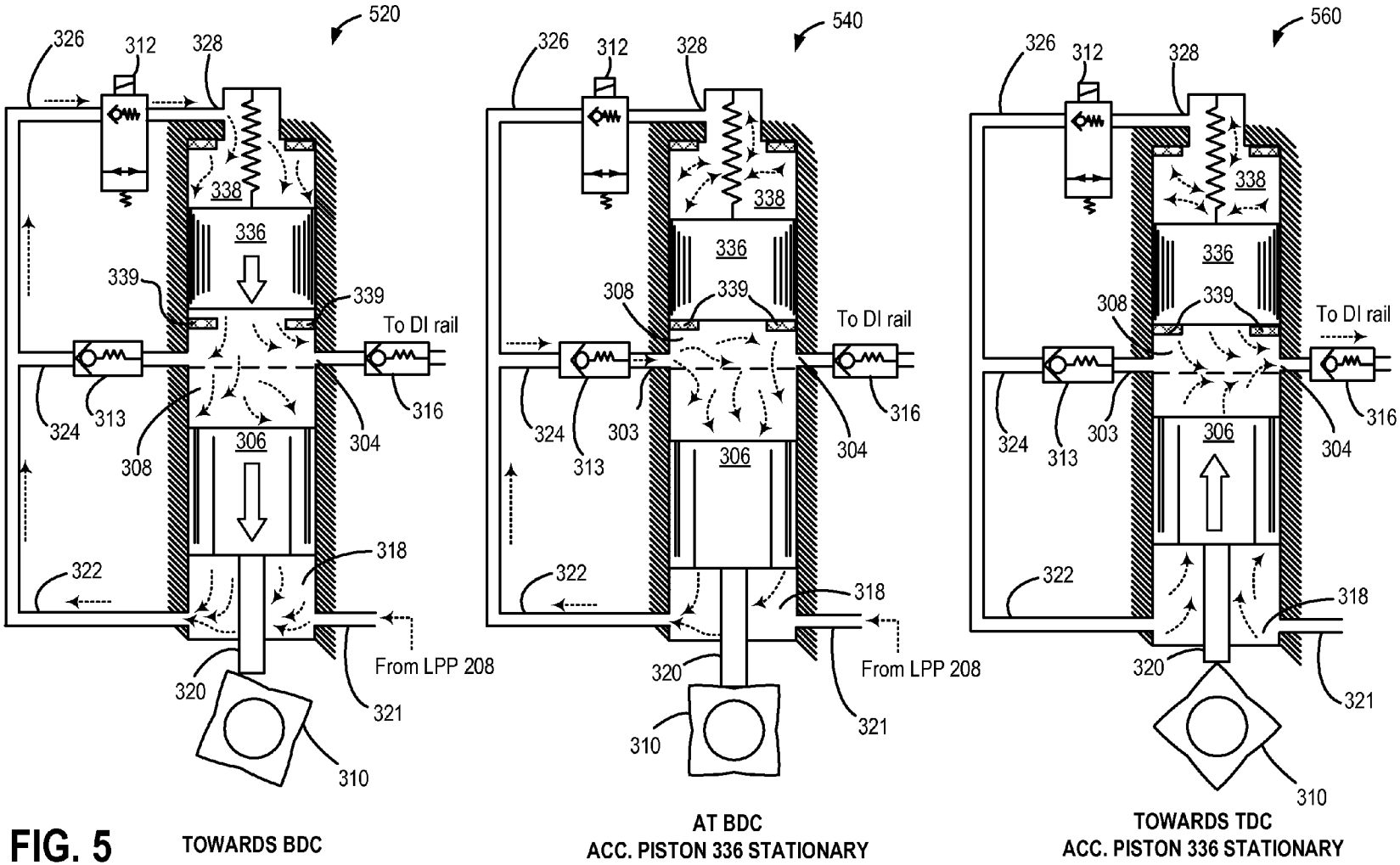
FIG. 5 illustrates a first example operation of the high pressure or direct injection fuel pump of FIG. 3 in a variable pressure mode.
Figure 6:
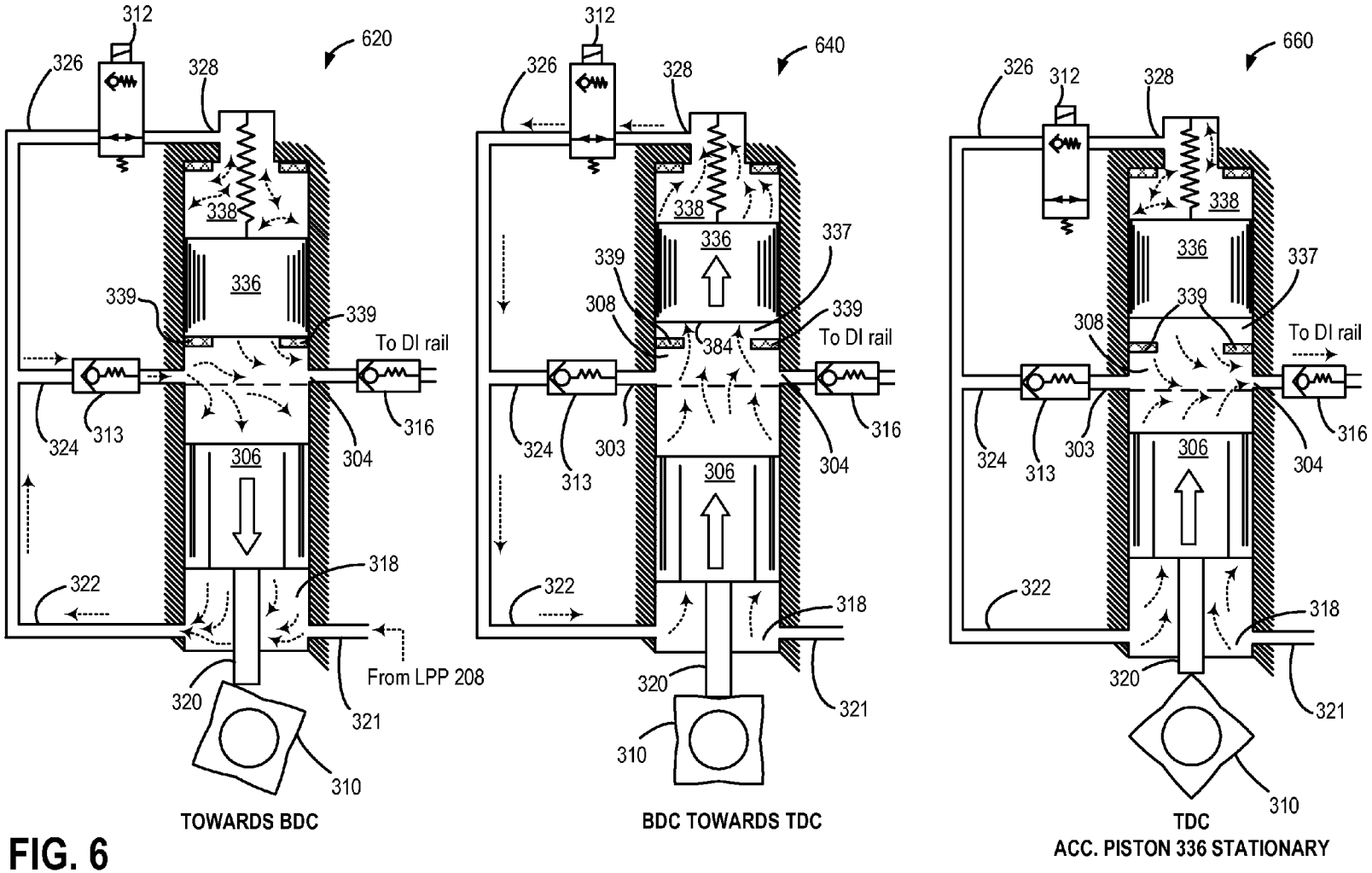
FIG. 6 depicts a second example operation of the high pressure or direct injection fuel pump of FIG. 3 in the variable pressure mode.
Figure 7:
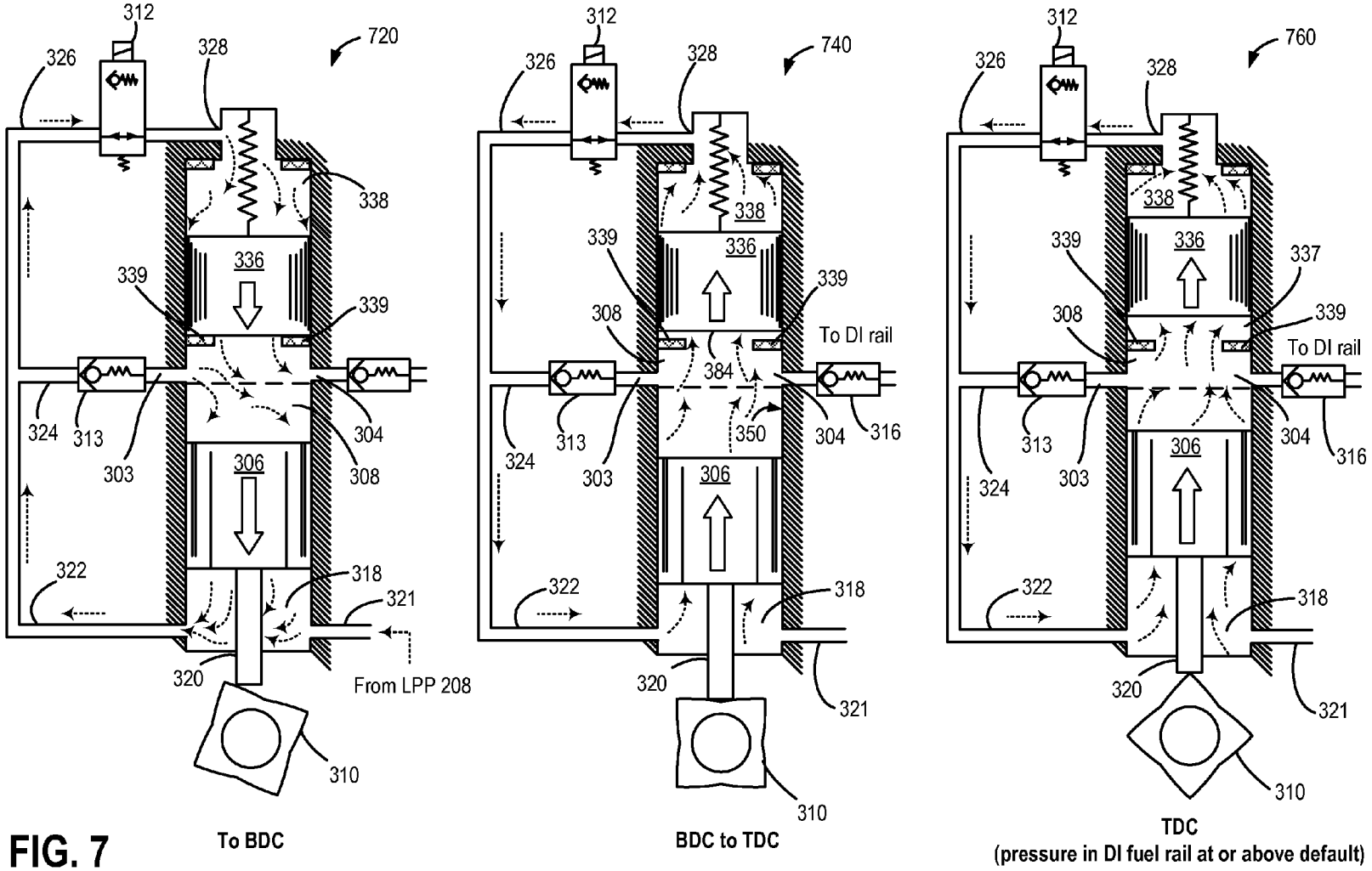
FIG. 7 presents an example operation of the high pressure or direct injection fuel pump of FIG. 3 in a default pressure mode when fuel rail pressure in a direct injection fuel rail is at a default pressure.

The following description provides information regarding an example system for a direct injection or higher pressure fuel pump in a fuel system, such as the example fuel system of FIG. 2, of an example engine system, such as the example engine system depicted in FIG. 1. The fuel system may include a lower pressure pump in addition to the higher pressure pump. Further, the higher pressure (or direct injection) fuel pump may include an accumulator positioned in a coaxial manner within a bore of the direct injection pump (FIG. 3). The accumulator may be arranged downstream of a solenoid activated check valve. When the solenoid activated check valve is activated and energized (and operated synchronously with a pump stroke in the direct injection pump), the direct injection fuel pump may operate in a variable pressure mode to provide a desired pressure in a direct injection fuel rail (FIGS. 5 and 6). During engine conditions when direct injection of fuel is substantially reduced, the higher pressure fuel pump may be operated in a default pressure mode by deactivating and de-energizing the solenoid activated check valve (FIG. 7). The accumulator may regulate pressure within a compression chamber of the direct injection fuel pump and the direct injection fuel rail and may also store fuel at a default pressure through at least a portion of a compression stroke in the pump in the default pressure mode. The default pressure may be higher than an output pressure of the lower pressure pump. If pressure in the direct injection fuel rail decreases below the default pressure, fuel stored in the accumulator may be streamed into the direct injection fuel rail (FIG. 8) to increase fuel rail pressure. A controller in the engine system may perform a routine such as that shown in FIG. 9 to control operation of the direct injection pump in the default pressure mode or the variable pressure mode based on engine conditions. Fuel flow into and out of the compression chamber of the pump in the variable pressure mode (FIG. 10) may be different from fuel flow into and out of the compression chamber of the pump in the default pressure mode (FIG. 11). A piston of the direct injection fuel pump, in alternative embodiments, may be coupled to a piston rod (or piston stem) with an external diameter substantially equal to an external diameter (FIG. 4*a*) of the piston to at least partially address issues associated with pump reflux. In another embodiment, the piston rod may have an external diameter that is about half the external diameter of the piston (FIG. 4*b*). By including the accumulator within the bore of the direct injection pump, fuel heating may be reduced and overall performance of the direct injection fuel pump may be enhanced.

Regarding terminology used throughout this detailed description, a high pressure pump, or direct injection fuel pump, may be abbreviated as a HP pump (alternatively, HPP) or a DI fuel pump respectively. Accordingly, HPP and DI fuel pump may be used interchangeably to refer to the high pressure direct injection fuel pump. Similarly, a low pressure pump, may also be referred to as a lift pump. Further, the low pressure pump may be abbreviated as LP pump or LPP. Port fuel injection may be abbreviated as PFI while direct injection may be abbreviated as DI. Also, fuel rail pressure, or the value of pressure of fuel within the fuel rail (most often the direct injection fuel rail), may be abbreviated as FRP. The direct injection fuel rail may also be referred to as a high pressure fuel rail, which may be abbreviated as HP fuel rail. Also, the solenoid activated inlet check valve for controlling fuel flow into the HP pump may be referred to as a spill valve, a solenoid activated check valve (SACV), electronically controlled solenoid activated inlet check valve, and also as an electronically controlled valve. Further, when the solenoid activated inlet check valve is activated, the HP pump is referred to as operating in a variable pressure mode. Further, the solenoid activated check valve may be maintained in its activated state throughout the operation of the HP pump in variable pressure mode. If the solenoid activated check valve is deactivated and the HP pump relies on mechanical pressure regulation without any commands to the electronically-controlled spill valve, the HP pump is referred to as operating in a mechanical mode or in a default pressure mode. Further, the solenoid activated check valve may be maintained in its deactivated state throughout the operation of the HP pump in default pressure mode.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated in FIG. 2, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion chamber 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake air passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single electronic driver 168 or 171 may be used for both fuel injection systems, or multiple drivers, for example electronic driver 168 for fuel injector 166 and electronic driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel from a fuel tank 202 to direct fuel injectors 252 and port injectors 242 of an engine, such as engine 10 of FIG. 1. Fuel system 8 may be operated by a controller, such as controller 12 of FIG. 1, to perform some of the operations described with reference to the example routine depicted in FIG. 8.

Fuel system 8 can provide fuel to an engine, such as example engine 10 of FIG. 1, from a fuel tank 202. By way of example, the fuel may include one or more hydrocarbon components, and may also include an alcohol component. Under some conditions, this alcohol component can provide knock suppression to the engine when delivered in a suitable amount, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost. As a specific non-limiting example, fuel may include gasoline and ethanol, (e.g., E10, and/or E85). Fuel may be provided to fuel tank 202 via fuel filling passage 204.

A low pressure fuel pump 208 (herein, also termed lift pump 208) in communication with fuel tank 202 may be operated to supply fuel from fuel tank 202 to a first group of port injectors 242, via a first fuel passage 230. Lift pump 208 may also be referred to as LPP 208, or a LP (lower pressure) pump 208. In one example, LPP 208 may be an electrically-powered lower pressure fuel pump disposed at least partially within fuel tank 202. Fuel lifted by LPP 208 may be supplied at a lower pressure into a first fuel rail 240 coupled to one or more fuel injectors of first group of port injectors 242 (herein also referred to as first injector group). An LPP check valve 209 may be positioned at an outlet of the LPP. LPP check valve 209 may direct fuel flow from LPP 208 to first fuel passage 230 and second fuel passage 290, and may block fuel flow from first and second fuel passages 230 and 290 respectively back to LPP 208.

While first fuel rail 240 is shown dispensing fuel to four fuel injectors of first group of port injectors 242, it will be appreciated that first fuel rail 240 may dispense fuel to any suitable number of fuel injectors. As one example, first fuel rail 240 may dispense fuel to one fuel injector of first group of port injectors 242 for each cylinder of the engine. Note that in other examples, first fuel passage 230 may provide fuel to the fuel injectors of first group of port injectors 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 (or DI pump 228 or high pressure pump 228) is included in second fuel passage 232 and may receive fuel via LPP 208. In one example, direct injection fuel pump 228 may be a mechanically-powered positive-displacement pump. Direct injection fuel pump 228 may be in communication with a group of direct fuel injectors 252 via a second fuel rail 250. Second fuel rail 250 may be a high (or higher) pressure fuel rail. Second fuel rail 250 may also be termed direct injection fuel rail 250. Direct injection fuel pump 228 may further be in fluidic communication with first fuel passage 230 via second fuel passage 290. Thus, fuel at lower pressure lifted by LPP 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in fuel tank 202 via fuel level sensor 206. Controller 12 may also receive an indication of fuel composition from one or more fuel composition sensors, in addition to, or as an alternative to, an indication of a fuel composition that is inferred from an exhaust gas sensor (such as sensor 128 of FIG. 1). For example, an indication of fuel composition of fuel stored in fuel tank 202 may be provided by fuel composition sensor 210. Fuel composition sensor 210 may further comprise a fuel temperature sensor. Additionally or alternatively, one or more fuel composition sensors may be provided at any suitable location along the fuel passages between the fuel storage tank and the two fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, fuel composition sensors 238 and 248, arranged at the fuel rails or along the fuel passages coupling the fuel injectors with fuel tank 202, can provide an indication of a fuel composition before being delivered to the engine. In contrast, fuel composition sensor 210 may provide an indication of the fuel composition at the fuel tank 202.

Fuel system 8 may also comprise pressure sensor 234 coupled to second fuel passage 290, and pressure sensor 236 coupled to direct injection fuel rail 250. Pressure sensor 234 may be used to determine a fuel line pressure of second fuel passage 290 which may correspond to a delivery pressure of low pressure pump 208. Pressure sensor 236 may be positioned downstream of DI fuel pump 228 in second fuel rail 250 and may be used to measure fuel rail pressure (FRP) in second fuel rail 250. Additional pressure sensors may be positioned in fuel system 8 such as at the first fuel rail 240 to measure the pressure therein. Sensed pressures at different locations in fuel system 8 may be communicated to controller 12.

LPP 208 may be used for supplying fuel to both the first fuel rail 240 during port fuel injection and the DI fuel pump 228 during direct injection of fuel. During both port fuel injection and direct injection of fuel, LPP 208 may be controlled by controller 12 to supply fuel to the first fuel rail 240 and/or the DI fuel pump 228 based on fuel rail pressure in each of first fuel rail 240 and second fuel rail 250. In one example, during port fuel injection, controller 12 may control LPP 208 to operate in a continuous mode to supply fuel at a constant fuel pressure to first fuel rail 240 so as to maintain a relatively constant port fuel injection pressure.

On the other hand, during direct injection of fuel when port fuel injection is OFF and deactivated, controller 12 may control LPP 208 to supply fuel to the DI fuel pump 228. During direct injection of fuel when port fuel injection is OFF, and when the pressure in second fuel passage 290 remains greater than a current fuel vapor pressure, LPP 208 may be temporarily switched OFF without affecting DI fuel injector pressure. Further, LPP 208 may be operated in a pulsed mode, where the LPP is alternately switched ON and OFF based on fuel pressure readings from pressure sensor 236 coupled to second fuel rail 250.

LPP 208 and the DI fuel pump 228 may be operated to maintain a prescribed fuel rail pressure in second fuel rail 250. Pressure sensor 236 coupled to the second fuel rail 250 may be configured to provide an estimate of the fuel pressure available at the group of direct injectors 252. Then, based on a difference between the estimated rail pressure and a desired rail pressure, each of the pump outputs may be adjusted. In one example, where the DI fuel pump 228 is operating in the variable pressure mode, the controller 12 may adjust a solenoid activated check valve of the DI fuel pump 228 to vary the effective pump volume (e.g., pump duty cycle) of each pump stroke.

In another example, such as when DI fuel pump 228 is operated in the default pressure mode and the solenoid activated check valve is de-energized to a pass-through state, the prescribed fuel rail pressure in the second fuel rail 250 may be a reduced pressure, such as a predetermined default pressure. The default pressure may, in one example, be lower than a pressure resulting from an activated solenoid spill valve. In another example, the default pressure may be higher than an output pressure of the LPP 208. Further, an accumulator arranged coaxially within the bore of the DI fuel pump 228 may store fuel in the default pressure mode. Specifically, the accumulator may store fuel through at least a portion of a compression stroke in the DI fuel pump 228. If fuel rail pressure in second fuel rail 250 is lower than the prescribed default pressure, fuel stored in the accumulator may be released into second fuel rail 250. The LPP 208 may be pulsed or continuously powered to provide fuel into the DI fuel pump 228.

In one example, a commanded pressure to LPP 208 may be between 2 to 7 bar (absolute). For example, the pressure commanded to LPP 208 may be such that the DI pump is ensured to ingest liquid fuel, not vapor. If excessive pressure is commanded to LPP 208, electrical power consumption by LPP 208 may increase leading to a reduction of a lifetime of LPP 208. An example default pressure may be higher than lift pump pressure. In one example, default pressure in the DI pump 228 may be 14 to 30 bar (absolute). However, since fuel heating may be reduced (or even averted) in the example embodiment described in the present disclosure, the default pressure in DI pump 228 may be selected to be higher without substantial concern for a fuel heating limit. An example commanded DI fuel rail pressure range may be from default pressure to 350 bar (absolute). Controller 12 can also control the operation of each of fuel pumps LPP 208 and DI fuel pump 228 to adjust an amount, pressure, flow rate, etc., of a fuel delivered to the engine. As one example, controller 12 can vary a pressure setting, a pump stroke amount, a pump duty cycle command, and/or fuel flow rate of the fuel pumps to deliver fuel to different locations of the fuel system. As one example, a DI fuel pump duty cycle (also termed, duty cycle of the DI pump) may refer to a fractional amount of a full DI fuel pump volume to be pumped. Thus, a 10% DI fuel pump duty cycle may represent energizing a solenoid activated check valve such that 10% of the DI fuel pump volume may be pumped. A driver (not shown) electronically coupled to controller 12 may be used to send a control signal to LPP 208, as required, to adjust the output (e.g. speed, delivery pressure) of the LPP 208. The amount of fuel that is delivered to the group of direct injectors via the DI fuel pump 228 may be adjusted by adjusting and coordinating the output of the LPP 208 and the DI fuel pump 228. For example, controller 12 may control the LPP 208 through a feedback control scheme by measuring the low pressure pump delivery pressure in second fuel passage 290 (e.g., with pressure sensor 234) and controlling the output of the LPP 208 in accordance with achieving a desired (e.g. set point) low pressure pump delivery pressure.

FIG. 3 illustrates example DI fuel pump 228 shown in the fuel system 8 of FIG. 2. As mentioned earlier in reference to FIG. 2, DI pump 228 receives fuel at a lower pressure from LPP 208 via second fuel passage 290. Further, DI pump 228 pressurizes the fuel to a higher pressure before pumping the fuel to direct injection fuel rail 250 and second group of injectors 252 (or direct injectors) via second fuel passage 232. It will be noted that DI fuel pump 228 may also be termed DI pump 228.

DI fuel pump inlet 399 may receive fuel via second fuel passage 290, from LPP check valve 209 fluidically coupled to LPP 208, and may direct the fuel to inlet check valve 313 and solenoid activated check valve 312. To elaborate, fuel may be received from DI fuel pump inlet 399 via first conduit 321 in DI fuel pump 228 which may then be directed into step room 318. Step room 318 may be a variable volume region in a bore 350 of the DI fuel pump 228 formed below pump piston 306 (or below piston bottom 307 of pump piston 306). The reciprocating motion of pump piston 306 may vary the volume of step room 318. From step room 318, fuel may stream through second conduit 322 towards each of solenoid activated check valve 312 (SACV 312) and inlet check valve 313. As depicted in FIG. 3, inlet check valve 313 may be coupled in third conduit 324 while SACV 312 is coupled in fourth conduit 326.

As such, a first portion of fuel may flow from second conduit 322 towards inlet check valve 313 via third conduit 324 and a second portion of fuel may flow from second conduit 322 towards SACV 312 via fourth conduit 326. Inlet check valve 313 may be positioned upstream of inlet 303 of compression chamber 308 in DI pump 228. Inlet check valve 313 may thus fluidically communicate with compression chamber 308 of DI fuel pump 228. It will also be noted that compression chamber 308 may receive fuel largely from inlet check valve 313. Inlet 303 may be supplied fuel via inlet check valve 313 which may receive fuel through third conduit 324, through second conduit 322, past step room 318 and via first conduit 321 from low pressure fuel pump 208, as shown in FIG. 3. SACV 312 may be located in fourth conduit 326 and an inlet of SACV 312 may, thus, fluidically communicate with LPP 208. Specifically, the inlet of SACV 312 (not indicated) may receive fuel via fourth conduit 326, through second conduit 322, past step room 318, and via first conduit 321 from LPP 208.

Further, SACV 312 may be positioned upstream of inlet port 328 of accumulator 340. As such, an outlet of SACV 312 may be fluidically coupled with accumulator 340 via inlet port 328. To elaborate, accumulator 340 may be arranged downstream from SACV 312 relative to fuel flow from fourth conduit 326 through SACV 312 into accumulator 340 via inlet port 328 of accumulator 340. Further, solenoid actuated check valve 312 may not be in-line with compression chamber 308 of DI fuel pump 228.

Accumulator 340 may be a pressure accumulator 340 comprising a spring 334 coupled to accumulator piston 336. A force constant of spring 334 may enable accumulator piston 336 to apply pressure on stored fuel, if any, in the accumulator 340. It will be observed that accumulator 340 is arranged coaxially within bore 350 of DI fuel pump 228. It will also be noted that accumulator piston 336 of accumulator 340 may be positioned within bore 350 such that a central axis of accumulator piston 336 may be parallel to a central axis of bore 350. In one example, the central axis of accumulator piston 336 may be the same as the central axis of bore 350. The accumulator piston may also be termed a plunger and may include an elastomeric seal.

As mentioned above, accumulator 340 includes spring 334 coupled to accumulator piston 336 wherein accumulator piston 336 may be disposed to move axially within bore 350. Further, accumulator piston 336 may move axially between two stops: a first stop 339 and a second stop 335. First stop 339 may be located towards compression chamber 308 of DI fuel pump 228 and thus, may be lower relative to a direction towards the compression chamber 308. Second stop 335 may be located towards an upper portion of accumulator 340 away from compression chamber 308. In addition, second stop 335 is depicted positioned closer to inlet port 328 of accumulator 340 relative to first stop 339. As such, region 338 may be accommodated above accumulator piston 336 within bore 350. To elaborate, region 338 may be surrounded by a top 323 of accumulator piston 336, walls of bore 350, and top 329 of bore 350. In some examples, region 338 may extend to top of accumulator 340 towards inlet port 328. Region 338 may include a variable volume, the volume varying based on the position of accumulator piston 336 at one of first stop 339, between first stop 339 and second stop 335, and at second stop 335. First stop 339 may block axial movement of accumulator piston 336 towards compression chamber 308. Similarly, second stop 335 may impede movement of accumulator piston 336 towards top 329 of bore 350. An example of the DI pump according to the present disclosure may include arranging accumulator displacement to exceed pump piston displacement in order to reduce the occasions when the accumulator piston would contact the second stop 335 (or upper stop).

It will be observed that accumulator 340 may fluidically communicate with compression chamber 308 of DI fuel pump 228. Further, accumulator 340 may be positioned above compression chamber 308. To elaborate, accumulator 340 may be arranged towards a first end of compression chamber 308, the first end being towards an upper portion of compression chamber 308.

The first portion of fuel may be delivered via inlet check valve 313 into compression chamber 308 and this first portion of fuel may be chiefly used for pumping into DI fuel rail 250. The second portion of fuel flowing through SACV 312 (whether the SACV is energized and functioning as a check valve or is de-energized to the pass-through state) may primarily enable and/or disable axial movement of accumulator piston 336. While direct injection is occurring, there may be an intermittent yet net flow of fuel through inlet check valve 313. SACV 312 may also experience intermittent flow, but there may be no net flow of fuel through SACV 312. It will be appreciated that a nominal (e.g., minimal) net flow may occur through SACV 312 if fuel in region 338 leaks past an interface between accumulator piston 336 and bore 350 into compression chamber 308.

In one example, if accumulator piston 336 is in its lowest position, such as at first stop 339, at the start of a pump intake stroke, fuel may not flow through SACV 312. As such, the second portion of fuel may be reduced (e.g., minimal) or may not occur. To elaborate, fuel exiting step room 318 may not flow into fourth conduit 326 into SACV 312 (no net flow). If accumulator piston 336 is at the first stop 339, region 338 may be filled with fuel. Accordingly, additional fuel may not flow into region 338 through SACV 312. However, a significant quantity of fuel may stream through inlet check valve 313 (as the first portion of fuel) into compression chamber 308 of DI pump 228.

In another example, if accumulator piston 336 is in its highest position (such that region 338 is reduced significantly), e.g. at second stop 335, at the start of the pump intake stroke, fuel may not initially flow into inlet check valve 313. Since accumulator piston 336 is not at the first stop 339, and the pump piston 306 is moving into the suction stroke, fuel can flow into region 338 through SACV 312. As such, as pump piston 306 begins the suction stroke, accumulator piston 336 may travel downwards towards first stop 339 in unison with pump piston 306. Herein, fuel may first flow through fourth conduit 326 into SACV 312, and thereon into inlet port 328 of accumulator 340 and therethrough into region 338. As fuel streams into region 338, accumulator piston 336 may travel towards first stop 339. For example, accumulator piston 336 may move synchronously with pump piston 306 in the pump intake stroke. Thus, towards the beginning of the intake stroke in the pump, a larger portion of fuel may flow through SACV 312. As such, the second portion of fuel may be greater than the first portion of fuel (flowing through inlet check valve 313) at the beginning of the intake stroke in the DI fuel pump. Once accumulator piston 336 contacts and rests at first stop 339 and further downward axial motion is impeded, fuel flow through SACV 312 ceases. Further still, fuel may now be drawn into compression chamber 308 predominantly from inlet check valve 313. Herein, the first portion of fuel may be greater than the second portion of fuel.

Compression chamber 308 may primarily receive fuel from inlet check valve 313. In some examples, compression chamber 308 may receive a substantially smaller quantity of fuel via SACV 312 and from region 338 in the form of nominal leakage past an exterior surface of accumulator piston 336 (as in, gap between exterior surface of accumulator piston 336 and bore 350). To elaborate, the first portion of fuel may be received in compression chamber 308 through inlet 303 of compression chamber 308 via inlet check valve 313 coupled in third conduit 324. The second portion of fuel may flow via SACV 312 into region 338 of accumulator 340 past spring 334. The second portion of fuel may then leak past accumulator piston 336 towards compression chamber 308. A nominal leak may also occur in the reverse direction from compression chamber 308 into region 338 during a compression stroke in the DI pump. As such, a gap may exist between accumulator piston 336 (or plunger 336) and bore 350 allowing fuel to leak past accumulator piston 336 into compression chamber 308 or vice versa. The fuel leaking across accumulator piston 336 may aid lubrication but may be largely unrelated to the pumping function. It will be appreciated that the leakage flow of fuel past accumulator piston (towards compression chamber from region 338 or into region 338 from compression chamber 308) may be small (e.g., minimal).

The fuel received in compression chamber 308 may be pressurized upon its passage through direct injection fuel pump 228 and may be supplied to second fuel rail 250 and direct injectors 252 through pump outlet 304. In the depicted example, direct injection pump 228 may be a mechanically-driven displacement pump that includes a pump piston 306 and piston rod 320 (also termed, piston stem 320), compression chamber 308 (herein also referred to as pump compression chamber), and step room 318. When pump piston 306 is at a bottom dead center (BDC) position in FIG. 3, the pump displacement may be represented as displacement volume 377. The displacement of the DI pump may be measured as the area swept by pump piston 306 as it moves from top dead center (TDC) to BDC or vice versa. A second volume also exists within compression chamber 308, the second volume being a clearance volume 378 of the DI fuel pump. The clearance volume defines the region in compression chamber 308 that remains when pump piston 306 is at TDC. In other words, the addition of displacement volume 377 and clearance volume 378 form compression chamber 308. Clearance volume 378 (also termed, dead volume 378) may be a variable volume in DI pump 228. Clearance volume 378 may be lower (e.g. at a minimum) when accumulator piston 336 is positioned at the first stop 339. On the other hand, clearance volume 378 may be higher (e.g. at a maximum) when accumulator piston 336 is arranged at the second stop 335. Clearance volume 378 may then include region 337 formed underneath bottom surface 384 (and above first stop 339) of accumulator piston 336.

Pump piston 306 includes a piston top 305 and a piston bottom 307. The step room and compression chamber may include cavities positioned on opposing sides of the pump piston. In one example, driving cam 310 may be in contact with piston rod 320 of the DI pump 228 and may be configured to drive pump piston 306 from BDC to TDC and vice versa, thereby creating the motion (e.g., reciprocating motion) necessary to pump fuel through compression chamber 308. Driving cam 310 includes four lobes and completes one rotation for every two engine crankshaft rotations.

Pump piston 306 reciprocates up and down within bore 350 to pump fuel. DI fuel pump 228 is in a compression stroke when pump piston 306 is traveling in a direction that reduces the volume of displacement volume 377 in compression chamber 308. Conversely, direct fuel injection pump 228 is in a suction or intake stroke when pump piston 306 is traveling in a direction that increases the volume of displacement volume 377 in compression chamber 308.

As depicted in FIG. 3, accumulator 340 may be arranged coaxially within bore 350 of the DI fuel pump. As mentioned earlier, accumulator piston 336 (and accumulator 340) may be arranged at the first end of compression chamber 308. Pump piston 306 may be positioned towards a second end of the compression chamber 308 of the DI fuel pump 228. Thus, the compression chamber 308 may be bordered by the bore 350 (specifically, walls of the bore 350), the accumulator 340 (specifically, accumulator piston 336 or plunger 336 of the accumulator), and the pump piston 306. As such, the accumulator piston 336 and the pump piston 306 may be located on opposing sides of compression chamber 308. In other words, the pump piston 306 and the accumulator piston 336 are arranged across from each other with compression chamber 308 in between. As such, the pump piston 306 may be positioned opposite from the accumulator piston 336 across the compression chamber 308. Further, it will be appreciated that accumulator 340 and pump piston 306 may be positioned within the same, common bore 350 of DI fuel pump 228. Thus, the accumulator 340 and the pump piston 306 share the bore 350 of the DI fuel pump 228. In other words, pump piston bore may be common with, and the same as, a bore in which accumulator piston of pressure accumulator 340 moves axially.

It will be appreciated that the accumulator 340 may located opposite from pump piston 306. In other words, the accumulator 340 is positioned at a first end of bore 350 while pump piston 306 is positioned at a second end of bore 350, the first end of bore 350 and the second end of bore 350 being opposite (or across) from each other.

Controller 12 may be configured to regulate fuel flow through solenoid activated check valve 312 by energizing or de-energizing a solenoid within solenoid activated check valve 312 (based on the solenoid valve configuration) in synchronism with the driving cam 310. Accordingly, solenoid activated check valve 312 may be operated in two modes. In a first mode, solenoid activated check valve 312 may be energized and actuated to limit (e g, inhibit) the amount of fuel traveling through solenoid activated check valve 312 in an upstream direction from region 338 via inlet port 328 of accumulator 340 towards fourth conduit 326. In the first mode (or the variable pressure mode), fuel may flow substantially from upstream of solenoid activated check valve (SACV) 312, through solenoid activated check valve 312, to downstream of solenoid activated check valve 312, and towards inlet port 328 of accumulator 340. That is, fuel flow may be allowed from fourth conduit 326 through SACV 312 into inlet port 328 of accumulator 340 and thereon into region 338. Further, SACV 312 may impede fuel flow from region 338 to upstream of SACV 312. As such, SACV 312 may be functioning as a check valve when energized, and not in pass-through state, in the first mode.

A first example of operating the SACV 312 in the first mode may include a 100% duty cycle of the DI fuel pump 228, wherein accumulator piston 336 may be arranged at first stop 339 (e.g., lower stop towards compression chamber 308), and may be substantially stationary through pump piston strokes. For example, the accumulator piston may be held stationary via hydraulic methods at first stop 339. The 100% duty cycle of the DI fuel pump may be utilized when full pump strokes are demanded for engine operation. The position of accumulator piston 336 may not change through pump operation as SACV 312 substantially blocks fuel flow out of region 338 (from downstream of SACV 312) by functioning as a check valve. In other words, fuel may be largely trapped in region 338 between inlet port 328 and accumulator piston 336 inhibiting movement of accumulator piston 336 towards second stop 335. In some examples, a smaller quantity of the fuel trapped in region 338 may, however, leak past the edge of accumulator piston 336 (e.g. between edge of accumulator piston 336 and bore 350) into compression chamber 308 and vice versa (from compression chamber 308 towards region 338). The leak may be based on a pressure differential between region 338 and compression chamber 308. Thus, in the first example of the 100% duty cycle of the DI fuel pump, substantially the entire second portion of fuel received from inlet check valve 313 into compression chamber 308 may be displaced by the rising pump piston 306 and may exit compression chamber 308, and DI fuel pump 228 via forward flow outlet check valve 316 into fuel rail 250.

A second example of SACV operation in the first mode may be a 50% duty cycle of the DI fuel pump in response to a demand of lower fuel flow into DI fuel rail 250. Herein, during the suction stroke and a first part of the compression stroke (of the DI pump), SACV 312 may function in the pass-through state. Accumulator piston 336 may be arranged at first stop 339 at a beginning of the suction stroke. If accumulator piston 336 is not positioned at first stop 339 but is positioned between first stop 339 and second stop 335, the second portion of fuel from second conduit 322 may flow through SACV 312 into region 338 of the accumulator as a downward axial movement of accumulator piston 336 towards first stop 339 occurs during the suction stroke. The second portion of fuel may flow through SACV 312 when the pump piston 306 travels downwards in the suction stroke increasing clearance volume 378. After accumulator piston 336 motion is impeded by first stop 339, the lower pressure in the compression chamber 308 (during suction stroke) may draw additional fuel from inlet check valve 313. This additional fuel (or the first portion of fuel) received via inlet check valve 313 may directly enter compression chamber 308.

For the first part (e.g., 50%) of the compression stroke, the SACV 312 may remain open allowing fuel to flow from region 338 through SACV 312 to upstream of SACV 312 as pump piston moves towards TDC position. Accumulator piston 336 may also move upwards in unison with pump piston 306 in the compression stroke impelling fuel in region 338 to flow out through SACV 312 towards fourth conduit 326. As such, fuel flow may not be directed towards the DI fuel rail 250 or the engine. About halfway (e.g., 50%) through the compression stroke of the pump piston 306, SACV 312 may be closed (or energized to function as a check valve) obstructing fuel flow from region 338. Consequently, the upward motion of accumulator piston 336 may now be blocked, and pressure in the compression chamber 308 may rise rapidly in the latter half of the compression stroke. It will be noted that as fuel flow through SACV 312 is obstructed, the position of accumulator piston 336 may be fixed and accumulator piston 336 may be held stationary e.g., hydraulically. When fuel pressure in the compression chamber 308 exceeds fuel rail pressure in the DI fuel rail 250, the remaining portion (e.g., 50%) of the compression stroke may deliver fuel to the DI fuel rail 250 and the engine. Herein, pump piston 306 may continue to travel upwards towards clearance volume 378 in the remainder portion of the compression stroke while accumulator piston 336 remains stationary.

Thus, SACV 312 may regulate a motion of accumulator piston 336 via allowing or blocking fuel flow through SACV 312 into (and out of) region 338. Further, SACV 312 may also regulate pressure (as well as volume) in the compression chamber (and in the DI Fuel rail).

In a second mode, solenoid activated check valve 312 may be de-energized and effectively disabled such that fuel can travel both upstream and downstream of solenoid activated check valve 312 (also termed, a pass-through state). Herein, the position of accumulator piston 336 may not be fixed since fuel may flow (into and) out of region 338 past inlet port 328 through SACV 312 towards upstream of SACV 312. The second mode may be a mechanical mode or also termed, default pressure mode. Since the accumulator piston 336 can move axially in this mechanical mode, it may store fuel for at least a portion of the compression stroke. Fuel may be stored in the accumulator 340 when accumulator piston 336 is not arranged at first stop 339 but positioned at between first stop 339 and second stop 335. Further, fuel may be stored in the accumulator 340 when pump piston 306 is performing a compression stroke, and as accumulator piston 336 is simultaneously shifting upwards towards second stop 335 creating region 337 below bottom surface 384 of accumulator piston 336. As such, region 337 may be considered a part of clearance volume 378. When SACV 312 is in the pass-through position, accumulator piston 336 may move synchronously with pump piston 306 and a default pressure may be established in the compression chamber 308 for at least a duration of a compression stroke in the DI fuel pump 228. If fuel rail pressure in the DI fuel rail 250 exceeds the default pressure, fuel in the compression chamber (and accumulator 340) may not be pushed out via forward flow outlet check valve 316. However, when fuel rail pressure in DI fuel rail 250 is lower than the default pressure, at least a first quantity of fuel stored in accumulator 340 during the compression stroke along with a second quantity of fuel from compression chamber 308 may be supplied to DI fuel rail 250.

It will be noted that in an alternative embodiment of the DI fuel pump, a default position of SACV 312 may be a fully shut position instead of implementing the check valve as the default position. SACV 312 may be closed about halfway (or midway) through an intake stroke in the DI fuel pump, which would enable the accumulator piston to be fixed at a halfway position. The halfway position of the accumulator piston may be a position of accumulator piston 336 between first stop 339 and second stop 335 attained at the halfway point of the intake stroke. Further, any additional fuel desired in compression chamber may be supplied via inlet check valve 313. As such, compression chamber 308 may be over-filled during a remaining part (e.g. half) of the intake stroke. Herein, fuel may be stored at the default pressure (as set by the spring in the accumulator). It will be appreciated that a potential issue with the above embodiment may be cavitations of fuel in region 338 of accumulator 340.

In other embodiments, the check valve within SACV 312 could be replaced with a shut-off valve. In other words, a binary shut-off valve variable between an open and a closed position may be used instead of the depicted example which portrays SACV 312 as a combination of an open valve and a check valve.

During pump operation in the variable pressure mode or the first mode, SACV 312 may be configured to regulate the mass (or volume) of fuel compressed within DI fuel pump 228. In one example, controller 12 may adjust a closing timing of SACV 312 to regulate the mass of fuel compressed. For example, closing SACV 312 at a later time relative to piston compression stroke (e.g., volume of compression chamber is decreasing) may reduce the amount of fuel mass delivered from the compression chamber 308 to pump outlet 304 since fuel in region 338 may be allowed to exit through SACV 312. As fuel in region 338 reduces, the accumulator piston 336 may shift upwards increasing clearance volume 378. Accordingly, fuel may be displaced from the compression chamber 308 into region 337 (not indicated in FIG. 3) formed below bottom surface 384 of accumulator piston 336 as the accumulator piston 336 shifts towards second stop 335 before the SACV closes.

In contrast, an early SACV closing relative to piston compression may increase the amount of fuel mass delivered from the compression chamber 308 to the pump outlet 304 since less of the fuel displaced from region 338 can flow through the electronically controlled SACV 312 (in reverse direction, towards upstream of SACV 312) before it closes. Accordingly, the shift of accumulator piston 336 towards second stop 335 may be smaller relative to that in the later closing of the SACV. Further, the volume of region 337 that can be formed underneath bottom surface 384 of accumulator piston 336 because of the upward shift of accumulator piston 366 may be reduced.

In both default and variable pressure modes of operation, the presence of accumulator piston 336 and spring 334 may enable a minimum pressure in direct injection fuel rail 250 (default pressure). Once pressure in the compression chamber 308 rises above the default pressure, as it would in variable pressure mode, the default pressure may not be relevant. The fuel rail pressure rise in the DI fuel rail 250 may then be a result of an additional fuel quantity forced into the DI fuel rail 250 from compression chamber 308.

Opening and closing timings of SACV 312 may be coordinated with stroke timings of the DI fuel pump 228. Inlet check valve 313 opens to allow fuel to flow from third conduit 324 into compression chamber 308 only after accumulator piston 336 is stationary at first stop 339.

When solenoid activated check valve 312 is deactivated (e.g., not electrically energized), and DI fuel pump 228 is operating in the default pressure mode (or the second mode), solenoid activated check valve 312 operates in a pass-through mode. In this mode, the position of accumulator piston 336 may be variable since fuel may not be trapped in region 338. As such, fuel may flow to and from region 338 through SACV 312. Thus, the accumulator 340 may store fuel within a region (e.g. region 337) below accumulator piston 336 and above first stop 339. Specifically, fuel may be stored between a bottom surface 384 of accumulator piston 336 and first stop 339. As such, a proportion of fuel may also be stored in clearance volume 378 when pump piston 306 is at TDC position. Clearance volume 378 may be a volume of the compression chamber estimated when pump piston 306 is at TDC, the estimation being the volume bounded by the top 305 of pump piston 306, the bottom surface 384 of accumulator piston 336, walls of the bore 350, inlet check valve 313, and forward flow outlet check valve 316. This clearance volume may be variable. As such, this clearance volume may differ between a fixed portion and a variable portion that becomes positive as accumulator piston 336 rises off the first stop 339 (also termed, lower stop 339) and region 337 is increased.

If SACV 312 is in pass-through mode and accumulator piston 336 is not in contact with either of the first stop or the second stop, the pressure of the fuel stored within accumulator 340 may be based on a force constant of spring 334 especially during a portion of a compression stroke in the DI fuel pump. In another example, the pressure of the fuel stored within accumulator 340 may be based on a force constant of spring 334 in addition to pump inlet pressure at 399. Herein, a force may be applied by spring 334 to accumulator piston 336 enabling fuel to be stored at a desired default pressure. Further, the default pressure may be higher than a pressure at an outlet of LPP 208. The accumulator 340 may, thus, regulate pressure within the compression chamber 308 and direct injection fuel rail 250.

Regulating the pressure in compression chamber 308 allows a pressure differential to form between piston top 305 to piston bottom 307. Pressure in the compression chamber 308 may be at the desired default pressure while pressure in step room 318 may be at the pressure of the outlet of the low pressure pump (e.g., 5 bar). To elaborate, pressure at piston top 305 may be at a regulation pressure based on force constant of spring 334 (e.g., 15 bar). The pressure differential allows fuel to seep from piston top 305 (or compression chamber 308) to piston bottom 307 (or step room 318) through a clearance between pump piston 306 and pump bore 350, thereby lubricating direct injection fuel pump 228.

Thus, during conditions when DI fuel pump operation is regulated mechanically, controller 12 may deactivate solenoid activated inlet check valve 312 and accumulator 340 may regulate pressure in second fuel rail 250 (and compression chamber 308). As such, pressure in the compression chamber 308 may vary within a range. For example, pressure in the compression chamber may not exceed a value determined by the accumulator. Further, pressure in the compression chamber may return to approximately the lift pump pressure at the end of each pump stroke (e.g., when pump piston 306 reaches BDC). An axial motion of the accumulator piston in the default pressure mode may regulate pressure within the compression chamber 308. For example, when the accumulator piston 336 is drawn towards first stop 339 (and pump piston is substantially at BDC) in the suction stroke of the DI pump, pressure in the compression chamber may be substantially similar to that at an outlet of the lift pump. On the other hand, when the accumulator piston is arranged between first stop 339 and second stop 335 in the compression stroke, and spring 334 is exerting a force on the accumulator piston, pressure in the compression chamber may be substantially at the default pressure. In one example, stored fuel may be fuel encompassed in clearance volume 378 and region 337. In another example, stored fuel may include fuel in compression chamber 308 in addition that fuel in clearance volume 378 and region 337.

In one example, accumulator 340 may be a 15 bar accumulator. In another example, accumulator 340 may be a 20 bar accumulator. One result of this regulation method is that the fuel rail is regulated to a minimum pressure (or default pressure) approximately at the pressure setting of accumulator 340 for at least a portion of the compression stroke in the DI fuel pump. Thus, if accumulator 340 is a 15 bar accumulator, the fuel rail pressure in second fuel rail 250 may be about 15 bar because the accumulator pressure setting is 15 bar. In yet another example, if accumulator 340 is a 15 bar accumulator, pressure of the fuel stored in the accumulator may vary from 20 bar (15 bar of the accumulator pressure added to 5 bar of lift pump pressure) to approximately 5 bar of the lift pump pressure. The higher pressure may be attained during a portion of the compression stroke in the DI fuel pump. Thus, the fuel pressure in compression chamber 308 may also be regulated during the compression stroke of direct injection fuel pump 228 to that of default pressure.

While the above example describes a variation in the compression chamber pressure between a value determined by the accumulator and the lift pump pressure, in another example the accumulator may be capable of moving (along its entire travel distance) while providing the same pressure. However, this may not be possible since the spring in the accumulator will provide more force as it is compressed.

It will be appreciated that the solenoid activated check valve 312 is maintained deactivated and de-energized in a pass-through state throughout the operation of the DI fuel pump 228 in the default pressure mode.

Operation of the solenoid activated check valve 312 (e.g., when energized) may result in increased NVH because cycling the solenoid activated check valve 312 may generate ticks as the valve is seated or is fully opened against the fully open valve limit. Furthermore, when the solenoid activated check valve 312 is de-energized to pass through mode, NVH arising from valve ticks may be substantially reduced. As an example, the solenoid activated check valve 312 may be de-energized and the DI pump may be operated in default pressure mode when the engine is idling since during engine idling conditions fuel is largely injected via port fuel injection. As such, the NVH arising from valve ticks may be relatively low whether fuel is injected via port fuel injectors at 5 bar or via direct injection at 20 bar.

Forward flow outlet check valve 316 (also termed outlet check valve 316) may be coupled downstream of outlet 304 of the compression chamber 308 of DI fuel pump 228. Outlet check valve 316 opens to allow fuel to flow from the outlet 304 of compression chamber 308 into second fuel rail 250 only when a pressure at the pump outlet 304 of direct injection fuel pump 228 (e.g., a compression chamber outlet pressure) is higher than the fuel rail pressure. In another example DI fuel pump, inlet 303 to compression chamber 308 and outlet 304 may be the same port.

A fuel rail pressure relief valve 314 is located parallel to outlet check valve 316 in a parallel passage 319 that branches off from second fuel passage 232. Fuel rail pressure relief valve 314 may allow fuel flow out of fuel rail 250 and second fuel passage 232 into compression chamber 308 when pressure in parallel passage 319 and second fuel passage 232 exceeds a predetermined pressure, where the predetermined pressure may be a relief pressure setting of fuel rail pressure relief valve 314. As such, fuel rail pressure relief valve 314 may regulate (e.g., limit) pressure in fuel rail 250. Fuel rail pressure relief valve 314 may be set at a relatively high relief pressure such that it acts only as a safety valve that does not affect normal pump and direct injection operation.

As described earlier, accumulator 340 stores fuel (for at least a portion of compression stroke in the DI fuel pump 228) when solenoid activated check valve 312 is deactivated and acting as a pass-through opening, and DI fuel pump 228 is in default pressure mode. The accumulator 340 may store fuel that is not delivered to the DI fuel rail 250 during each compression stroke. For a significant part of the compression stroke, pressure in compression chamber 308 may be at the accumulator set pressure (e.g., based on accumulator pressure) providing a pressure difference between top 305 of pump piston 306 and bottom 307 of pump piston 306. Accumulator 340 may also apply a positive pressure across the pump piston 306 during a portion of the piston intake (suction) stroke, further enhancing Poiseuille lubrication. In addition, a portion of compression energy from the positive pressure applied by pressure accumulator 340 on pump piston 306 may be transferred to a camshaft of driving cam 310. As such, a substantial portion of the energy stored in the accumulator may be returned to the pump piston 306 in an initial part of the intake stroke of pump piston 306.

It is noted that while pump 228 is shown in FIG. 2 as a symbol with no detail, FIG. 3 shows pump 228 in full detail. It is also noted here that DI pump 228 of FIG. 3 is presented as an illustrative example of one possible configuration for a DI pump that can be operated in an electronic regulation (or variable pressure) mode as well as in a default pressure or mechanically-regulated mode. Components shown in FIG. 3 may be removed and/or changed while additional components not presently shown may be added to DI fuel pump 228 while still maintaining the ability to deliver high-pressure fuel to a direct injection fuel rail with and without electronic pressure regulation.

Figure 4A:
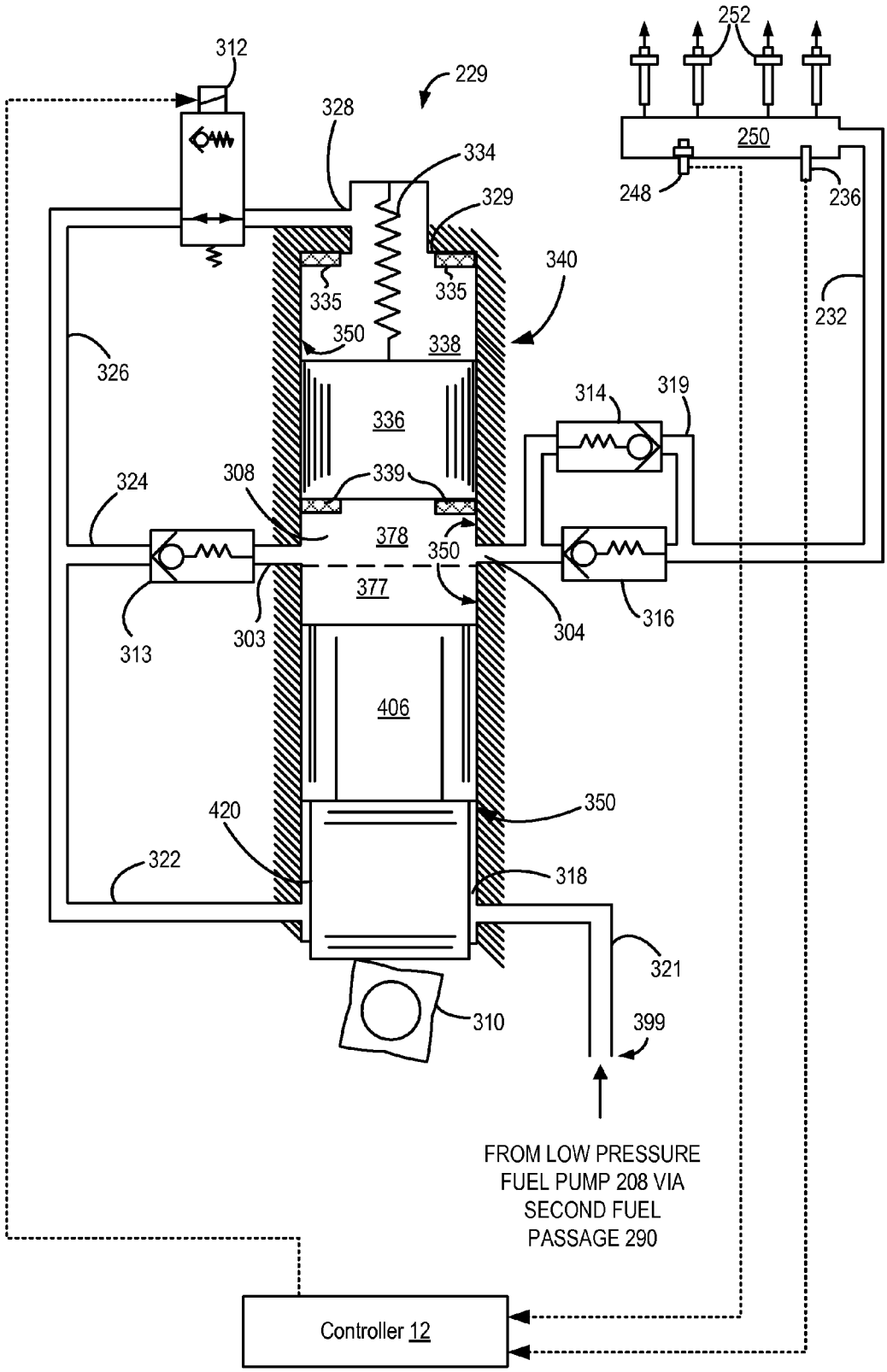
FIGS. 4*a* and 4*b* depict alternative examples of the high pressure or direct injection fuel pump of FIG. 3.
Figure 4B:
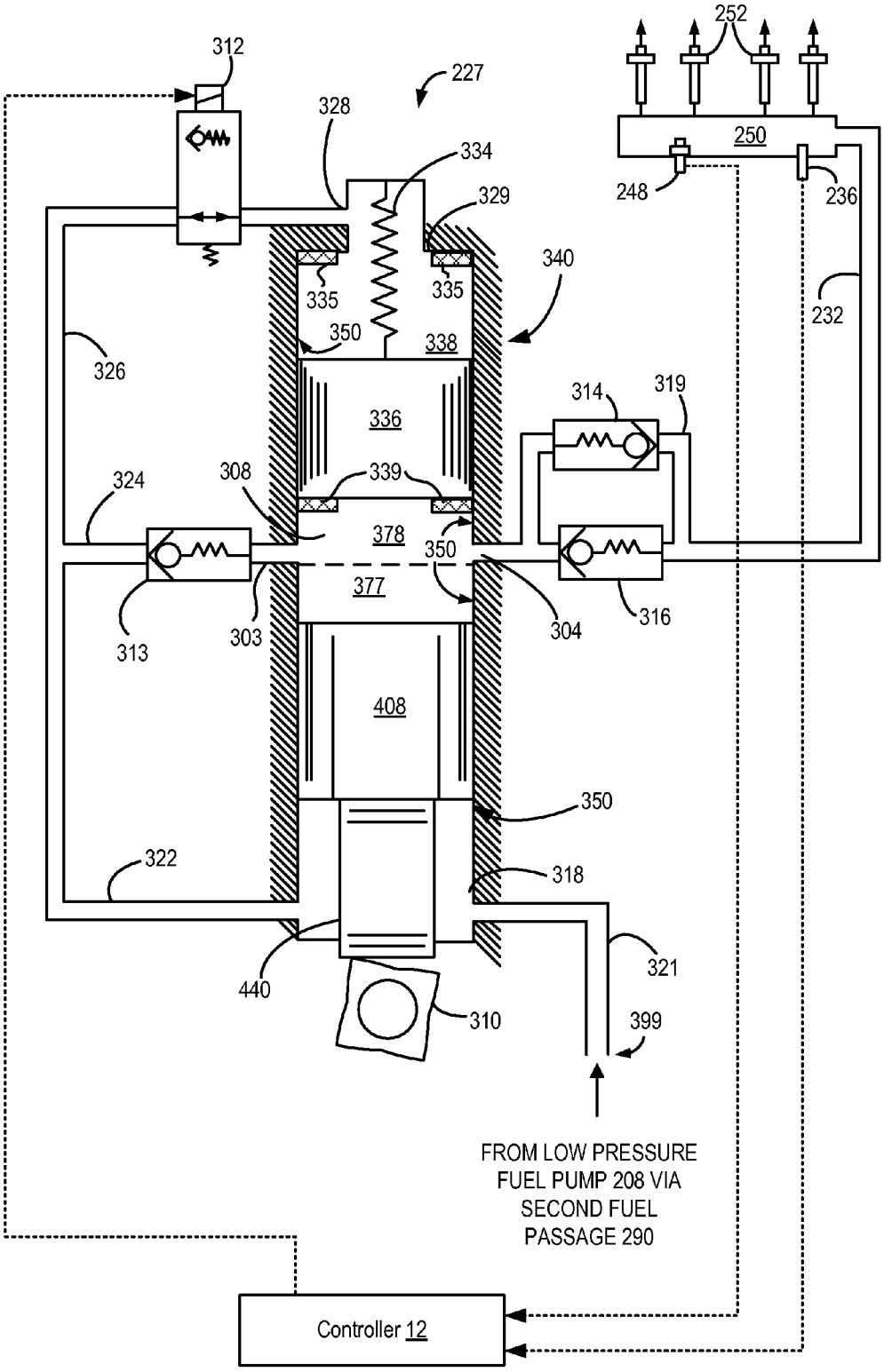

FIGS. 4*a* and 4*b* depict alternative embodiments of the DI fuel pump shown in FIG. 3. DI fuel pump 229 presented in FIG. 4*a* is similar to DI fuel pump 228 of FIG. 3 except for a modification in the diameter of the piston rod. DI fuel pump 227 of FIG. 4*b* is similar to pump 229 in FIG. 4*a* except for the diameter of the piston rod which is distinct from the piston rod in DI fuel pump 229. It will be appreciated that many components in DI fuel pump 229 of FIG. 4*a* and DI fuel pump 227 of FIG. 4*b* may be the same as components shown in DI fuel pump 228 of FIG. 3. Therefore, components previously introduced in FIG. 3 are numbered similarly in FIGS. 4*a* and 4*b* and are not reintroduced. Further, description of these components is omitted in the description of FIGS. 4*a* and 4*b*.

The alternative embodiment of FIG. 4*a* may bring about a reduction in pump reflux. Reflux may occur in piston-operated pumps such as DI pump 228 shown FIG. 3, wherein a portion of the pumped liquid (fuel in this case) is repeatedly forced into and out of the step room 318 into a low pressure fuel line, such as second fuel passage 290. The progression of pump reflux may be described as follows: during the compression stroke in the DI fuel pump, as the pump piston is traveling from bottom dead center (BDC) to top dead center (TDC), fluid may be sucked from the low pressure fuel line to the step room or volume under the piston. During the pump's suction (intake) stroke, as the pump piston is traveling from TDC to BDC, fluid may be forced from the bottom of the piston (the volume under the piston, step room 318) backward into the low pressure line or forward into second conduit 322.

Pump reflux may excite the natural frequency of the low pressure fuel supply line. The repeated, reversing fuel flow from the bottom of the piston may create fuel pressure and flow pulsations that may at least partially cause a number of issues. One of these issues may be increased noise caused by the flow pulsations, thereby requiring additional sound reduction components that may otherwise be unnecessary.

Pump reflux from the step room 318 of FIG. 3 may be reduced by incorporating a wider piston rod (e.g. piston rod with a larger diameter) in the DI fuel pump. As shown in FIG. 4*a*, an external diameter of piston rod 420 in DI fuel pump 229 is greater than that of an external diameter of piston rod 320 in DI fuel pump 228 of FIG. 3. In the example shown, the outside diameter of piston rod 420 (or piston stem 420) is equal or substantially equal to the outside diameter of pump piston 406. To easily differentiate between the stem and piston in FIG. 4*a*, the diameter of piston stem 420 is shown to be slightly smaller than the diameter of pump piston 406, when in reality the diameters may be equal.

Thus, step room 318 may be consumed by piston stem 420 in FIG. 4*a*, thereby significantly reducing the variable volume of step room 318 on the backside of pump piston 406. In other words, no vacuous volume is present on the backside of pump piston 406 in between the pump piston and the stem throughout the movement of the pump piston. In this way, as pump piston 406 (and the piston stem) move from TDC to BDC and vice versa, substantially no fuel may be expelled into and sucked from second fuel passage 290. Thus, pump reflux on the underside of pump piston 406 may be significantly reduced.

In an alternative embodiment shown in FIG. 4*b*, piston 408 is coupled to piston stem 440 wherein an exterior diameter of piston stem 440 is about half (e.g., 50%) the exterior diameter of piston 408. As such, piston stem 440 may have an outside diameter substantially half the size of an outside diameter of the pump piston 408. In this embodiment of FIG. 4*b*, the compression and intake strokes of pump piston 408 may produce substantially equivalent flow from a low pressure line such as second fuel passage 290 from LPP 208.

In this manner, an example system may comprise an accumulator positioned within a bore of a direct injection fuel pump in a coaxial manner, the accumulator positioned downstream from a solenoid activated check valve. The accumulator may be arranged above a compression chamber in the direct injection fuel pump, and further, the accumulator may be in fluidic communication with the compression chamber. The compression chamber of the direct injection fuel pump may receive fuel via an inlet check valve, the inlet check valve (e.g. 313 in FIG. 3) coupled to an inlet of the compression chamber (e.g., 303 in FIG. 3). The accumulator may include a spring coupled to a piston, the piston capable of moving axially in the bore of the direct injection fuel pump between a first stop and a second stop. Herein, the first stop may be located towards the compression chamber in the direct injection fuel pump, and the second stop may be located away from the compression chamber in the direct injection fuel pump. Further, a motion of the piston of the accumulator may be regulated by fuel flow through the solenoid activated check valve and a motion of a pump piston. As such, fuel fill in region 338 of accumulator 340 in FIG. 3 may enable regulation of motion of the piston 336 of the accumulator 340. Further, motion of pump piston 306 may affect motion of accumulator piston 336. When the solenoid activated check valve (e.g., 312 of FIG. 3) is de-energized and in a pass-through mode, a direction of the motion of the piston (e.g., 336) of the accumulator may be substantially in unison with a direction of motion of the pump piston (e.g., 306 of FIG. 3) in the direct injection fuel pump (e.g., DI fuel pump 228). Herein, the accumulator may store fuel during a portion of a compression stroke in the DI fuel pump at a given pressure, the given pressure being substantially equivalent to a desired default pressure in the compression chamber and the fuel rail. The given pressure may be based on a force constant of the spring of the accumulator. As such, the pump piston (e.g., 306) may be arranged opposite to the piston (e.g., 336 of FIG. 3) of the accumulator across the compression chamber (e.g., 308 of FIG. 3). In one alternative embodiment, such as DI fuel pump 229 of FIG. 4*a*, the direct injection fuel pump may include a piston stem coupled to the pump piston, the piston stem having an outside diameter substantially equal in size to an outside diameter of the pump piston. In yet another alternative embodiment, such as DI fuel pump 227 of FIG. 4*b*, the direct injection fuel pump may include a piston stem coupled to the pump piston, the piston stem having an outside diameter substantially half the size of an outside diameter of the pump piston.

Turning now to FIG. 5, it shows an example operation of DI fuel pump 228 in the variable pressure mode. Specifically, the example operation is for a full pump stroke, or a 100% duty cycle of the DI fuel pump. Herein, the SACV may be activated and energized (e.g., closed and impeding fuel exit from region 338 of accumulator 340) at a beginning of a compression stroke of pump piston 306. As such, the SACV, such as SACV 312, when activated and energized, may function as a check valve blocking flow of fuel from downstream of SACV 312 to upstream of SACV 312, e.g., from region 338 in accumulator 340 through SACV 312 to fourth conduit 326. Specifically, FIG. 5 depicts fuel flow in DI fuel pump 228 during three moments of pump piston operation. It will be appreciated that the same operation as depicted in FIG. 5 may be conducted with DI fuel pump 229 of FIG. 4*a* and with DI fuel pump 227 of FIG. 4*b* to reduce pump reflux from step room 318.

First view 520 shows fuel flow within DI fuel pump 228 when pump piston 306 is moving downwards towards BDC during an intake stroke. Second view 540 portrays fuel flow within DI fuel pump 228 when pump piston 306 is towards the end of the suction stroke and may soon begin moving upwards from BDC towards TDC (e.g., at beginning of a compression stroke in DI fuel pump 228). Third view 560 illustrates fuel flow as pump piston 306 reaches TDC position towards an end of the compression stroke. Fuel flow is depicted with dashed lines with arrows indicating direction of fuel flow.

In first view 520, pump piston 306 is depicted moving towards BDC position, and away from accumulator piston 336. Therefore, fuel residing in step room 318 (or fuel received from LPP 208) may be forced largely towards second conduit 322. Fuel may also flow from LPP 208 via first conduit 321 into step room 318. Herein, a relative amount of fuel flow, whether from step room 318 or from LPP 208, may depend on a size of the piston stem. By using a piston stem of approximately half an external diameter of pump piston 306 or by using a piston stem of substantially the same external diameter as pump piston 306, reflux flow towards LPP 208 may be reduced.

Second conduit 322, as mentioned earlier, may supply fuel to each of inlet check valve 313 and SACV 312. As shown in first view 520, fuel may initially flow through SACV 312 into region 338 of accumulator 340 as accumulator piston 336 moves downwards in unison with pump piston. It will be noted that since accumulator piston 336 is not already at first stop 339, accumulator piston 336 may travel towards first stop 339 during the suction stroke as shown in first view 520. Herein, accumulator piston 336 motion may follow that of pump piston 306. To elaborate, first view 520 shows both accumulator piston 336 and pump piston 306 moving downwards. Therefore, a second portion of fuel in second conduit 322 may flow towards fourth conduit 326 into SACV 312 enabling axial motion (e.g., towards first stop 339) of accumulator piston 336.

First view 520 also shows SACV functioning as a check valve allowing fuel to flow through towards region 338 e.g., from upstream of SACV 312 to downstream of SACV 312. SACV 312 may also be de-energized in first view 520 to a pass through mode allowing fuel flow into region 338. It will be noted that even though SACV 312 may be in pass-through mode in first view 520, fuel may primarily flow through SACV 312 towards region 338, and not the other way. This is because accumulator piston 336 is moving downwards towards first stop 339 in first view 520 resulting in an increase in volume of region 338. SACV 312 in this case may be energized to the check valve position when pump piston 306 commences its subsequent compression stroke.

It will also be noted that until accumulator piston 336 comes to a rest at first stop 339, fuel may not flow through inlet check valve 313 into inlet 303 of compression chamber 308 of DI pump 228. Accordingly, fuel flow is not indicated across inlet check valve 313 in first view 520.

Second view 540 depicts accumulator piston 336 positioned at first stop 339. Therefore, a first portion of fuel may now flow through inlet check valve 313 into compression chamber 308. In the 100% duty cycle operation of the DI pump, fuel flow in third conduit 324 and via inlet check valve 313 may be substantially large (e.g., maximum). Further, inlet check valve being a check valve that allows fuel flow in one direction, such as from third conduit 324 into inlet 303 of compression chamber 308, fuel flow may be in a forward direction alone. Further, there may be no net flow through fourth conduit 326 once accumulator piston 336 is at rest, and substantially fixed at first stop 339 (as shown in second view 540).

It will be noted that second view 540 depicts inlet check valve 313 as being open. As such, pressure in compression chamber may be considerably lower as the pump piston 306 is at the end of the suction stroke. A nominal (e.g., minimal) fuel flow may occur (not shown) past an edge of accumulator piston 336 from region 338 into compression chamber 308.

In second view 540, pump piston is depicted at BDC position and may subsequently commence moving towards TDC in a compression stroke. If SACV 312 has been in pass-through state, it may be energized at the beginning of the compression stroke to provide the 100% duty cycle. By energizing SACV 312, SACV 312 may function as a check valve and impede an exit of fuel from region 338 towards fourth conduit 326. Accordingly, accumulator piston 336 may not be able move in an upward direction. Thus, accumulator piston 336 may be stationary and fixed at first stop 339. FIG. 5 shows SACV 312 in its check valve position through all three moments in views 520, t40, and 560. Thus, fuel flow out of region 338 towards fourth conduit 326 may be impeded in all three moments.

Fuel in the compression chamber may be compressed as pump piston 306 moves towards accumulator 340. Specifically, fuel may be compressed between pump piston 306 and accumulator piston 336 as accumulator piston 336 is held stationary. Since fuel is substantially incompressible, pressure in compression chamber 308 may rise quickly after the SACV 312 is closed. In the depicted example of the 100% duty cycle, since SACV 312 obstructs upward motion of accumulator piston 336 from beginning of the compression stroke, the increase in pressure may occur towards the beginning phase of the compression stroke. As pressure in compression chamber 308 exceeds fuel rail pressure in DI fuel rail 250, pressurized fuel from compression chamber 308 may exit the DI fuel pump through forward flow outlet check valve 316 (as shown in third view 560) into DI fuel rail 250.

It will be noted that in the 100% duty cycle of the DI fuel pump, accumulator 340 may not store any fuel (e.g., in region 337) as accumulator piston 336 is substantially fixed at first stop 339 by the presence of fuel in region 338 and by SACV 312 blocking fuel flow out of region 338.

In third view 560, pump piston 306 is depicted towards the end of the compression stroke. Accumulator piston 336 continues to be stationary at first stop 339. As pump piston 306 moves towards TDC position, fuel in the compression chamber 308 may be pushed out through outlet check valve 316 towards DI fuel rail 250. It will be noted that in third view 560, outlet check valve 360 is depicted as being open. The flow of fuel into DI fuel rail 250 may provide an increase in fuel rail pressure.

In this way, during a full pump stroke in the variable pressure mode, fuel pressure in the compression chamber 308 and the direct injection fuel rail 250 may be regulated by the solenoid actuated check valve 312. Accumulator 340 may not store fuel during the 100% duty cycle operation of the DI pump in the variable pressure mode.

Turning now to FIG. 6, it also shows an example operation of DI fuel pump 228 in the variable pressure mode but in a reduced pump stroke, or a less than 100% duty cycle of the DI fuel pump. As an example, FIG. 6 may illustrate a 50% duty cycle of the DI fuel pump. Herein, the SACV may be activated and energized (e.g., closed and impeding fuel exit from region 338 of accumulator 340) between a BDC position and a TDC position of pump piston 306 (e.g., halfway) in a compression stroke. As such, the SACV, such as SACV 312, when energized may function as a check valve blocking flow of fuel from downstream of SACV 312 to upstream of SACV 312, e.g. from region 338 in accumulator 340 through SACV 312 to fourth conduit 326.

Similar to FIG. 5, FIG. 6 depicts fuel flow in DI fuel pump 228 during three moments of pump piston operation. It will be appreciated that the same operation as depicted in FIG. 6 may be conducted with DI fuel pump 229 of FIG. 4*a* and with DI fuel pump 227 of FIG. 4*b* to reduce pump reflux from step room 318.

First view 620 shows fuel flow within DI fuel pump 228 when pump piston 306 is in an intake stroke. Second view 640 portrays fuel flow within DI fuel pump 228 at a moment when pump piston 306 is moving upwards from BDC towards TDC. Third view 660 illustrates fuel flow as pump piston 306 reaches TDC position towards an end of the compression stroke. Fuel flow is depicted with dashed lines with arrows indicating direction of fuel flow.

In first view 620, pump piston 306 is depicted moving towards BDC position, and away from accumulator piston 336. Therefore, fuel residing in step room 318 (or fuel received from LPP 208) may be forced largely towards second conduit 322. Further, in first view 620, accumulator piston 336 is at rest at first stop 339 and fuel may fill region 338. As such, a second portion of fuel may have streamed through SACV 312 into region 338 shifting accumulator piston 336 towards first stop 339 (as shown in first view 520 of FIG. 5).

As shown in first view 620, a first portion of fuel may be received via inlet check valve 313 into inlet 303 of compression chamber 308. Since accumulator piston 336 is at first stop 339, fuel may primarily flow from step room 318 (and LPP 208) through second conduit 322, into third conduit 324 and thereon through inlet check valve 313 into compression chamber 308. In first view 620, there may be no net flow of fuel through fourth conduit 326 as accumulator piston 336 is at first stop 339.

First view 620 also shows SACV as de-energized to a pass through mode since the DI pump is not functioning at 100% duty cycle.

In second view 640, pump piston is depicted moving towards TDC from BDC position in a compression stroke. SACV 312 may remain de-energized and in the pass-through state as the DI pump is in a reduced pump stroke cycle (e.g., less than the 100% duty cycle). As pump piston moves towards TDC, fuel in the compression chamber is impelled upwards towards bottom surface 384 of accumulator piston 336. Accordingly, accumulator piston 336 may be pushed upwards towards second stop 335. Since SACV 312 is in the pass-through state, axial motion of the accumulator piston 336 may be enabled as fuel in region 338 can exit through SACV 312 towards fourth conduit 326. Second view 640, thus, shows fuel exiting region 338 through SACV 312 into fourth conduit 326, and thereon to second conduit 322 and into step room 318. As such, volume of step room 318 may be increasing as pump piston 306 is moving upwards. It will be noted that fuel in compression chamber 308 may be displaced into region 337 created underneath bottom surface 384 of accumulator piston 336.

Since DI fuel pump 228 is operating in a less than 100% duty cycle (e.g., 50% duty cycle), the SACV 312 may remain de-energized and in pass-through state through about half of the compression stroke of the pump piston 306. As pump piston 306 reaches about half of its compression stroke, SACV 312 may be energized to a closed position. Specifically, SACV 312 may now function as a check valve blocking fuel flow out of region 338 through SACV 312 into fourth conduit 326. As fuel flow out of region 338 is impeded, axial motion of accumulator piston 336 towards second stop 335 comes to a halt. Consequently, accumulator piston 336 may remain substantially stationary and immobile at a position between first stop 339 and second stop 335. The position where the accumulator piston 336 is rendered stationary depends on when the SACV 312 is energized.

Third view 660 therefore shows SACV 312 as energized and functioning as a check valve obstructing the exit of fuel from region 338 towards fourth conduit 326. Further, accumulator piston 336 is shown stationary between first stop 339 and second stop 335. Subsequent to the energizing of SACV 312, fuel in the compression chamber may be compressed as pump piston 306 moves towards stationary accumulator piston 336 in accumulator 340 in the remainder of the compression stroke. Since fuel is substantially incompressible, pressure in compression chamber 308 may rise quickly after the SACV 312 is closed. As pressure in compression chamber 308 exceeds fuel rail pressure in DI fuel rail 250, pressurized fuel from compression chamber 308 may exit the DI fuel pump through forward flow outlet check valve 316 (as shown in third view 660) into DI fuel rail 250. It will be noted that in third view 560, outlet check valve 360 is depicted as being open. The flow of fuel into DI fuel rail 250 may provide an increase in fuel rail pressure.

In this way, during a reduced pump stroke (or a less than 100% duty cycle) in the variable pressure mode, fuel pressure in the compression chamber 308 and the direct injection fuel rail 250 may be regulated by the solenoid actuated check valve 312.

Turning now to FIG. 7, it shows an example operation of DI fuel pump 228 in the default pressure mode. Herein, the SACV is de-energized and functions in a pass-through state throughout the intake and compression strokes in the DI pump allowing fuel to flow either upstream of downstream of the SACV. Further, accumulator piston 336 may be capable of axial motion in unison with pump piston 306. As mentioned earlier, pressure in compression chamber 308 of DI fuel pump 228 may vary between a default pressure (or a given pressure) and an outlet pressure of lift pump 208. The default pressure may be based on a force constant of spring 334 of accumulator 340. In another example, the default pressure may be a combination of pressure due to the force constant of spring 334 in accumulator 340 and the outlet pressure of lift pump 208.

FIG. 7 specifically depicts fuel flow in DI fuel pump 228 during three moments from pump piston operation when fuel rail pressure in DI fuel rail 250 is higher than a default pressure in the DI fuel pump 228. It will be appreciated that the same operation as depicted in FIG. 7 may be conducted with DI fuel pump 229 of FIG. 4*a* and DI fuel pump 227 of FIG. 4*b* to reduce pump reflux from step room 318.

First view 720 shows fuel flow within DI fuel pump 228 when pump piston 306 is moving downwards towards BDC in a suction stroke. Second view 740 portrays fuel flow within DI fuel pump 228 when pump piston 306 is moving from BDC towards TDC. Third view 760 illustrates fuel flow as pump piston 306 reaches TDC position. Fuel flow is depicted with dashed lines with arrows indicating direction of fuel flow.

Referring to first view 720, accumulator piston 336 is shown coming to rest at first stop 339 without storing fuel. Herein, accumulator piston 336 may travel downwards in unison with pump piston 306 in the suction stroke until first stop 339 blocks further downward axial motion of accumulator piston 336. As in first view 520 of FIG. 5, a second portion of fuel may flow through SACV 312 through inlet port 328 into region 338 as accumulator piston 336 shifts downwards towards first stop 339. Thus, fuel is depicted as flowing from step room 318, into second conduit 322, through fourth conduit 326, across SACV 312, and thereon into region 338. As such, a forward flow of fuel may occur through first conduit 321 since volume of region 338 above accumulator piston 336 increases faster than volume of step room 318 decreases (due to the presence of the piston stem).

Once accumulator piston 336 is at first stop 339, additional fuel may or may not be received into compression chamber 308 via inlet check valve 313. In one example, when DI fuel rail pressure remains at or above a default pressure in the DI pump, additional fuel may not be received via inlet check valve 313. In another example, following an injection through one or more direct injectors coupled in DI fuel rail 250, fuel rail pressure may be reduced and may be lower than the default pressure. In response to the reduction in fuel rail pressure in DI fuel rail 250, fuel from compression chamber 308 may be directed through forward flow outlet check valve 316 into DI fuel rail 250. Accordingly, a volume of fuel in compression chamber 308 may be lower resulting in an intake of fuel from inlet check valve 313 during the suction stroke in the DI fuel pump.

First view 720 of FIG. 7 depicts the first example wherein fuel rail pressure in DI fuel rail 250 is at or above the default pressure wherein no fuel may enter compression chamber 308 via inlet check valve 313 during the suction stroke. In an example wherein leakage may be present, a reduced (e.g. minimal) quantity of fuel may be received in compression chamber 308 via inlet check valve 313.

Second view 740 shows pump piston 306 commencing a compression stroke to move towards TDC from BDC. As such, when pump piston is at or near BDC in the suction stroke, pressure in the compression chamber may be substantially similar to lift pump pressure (e.g., pressure at outlet of the lift pump). Fuel in the compression chamber may be impelled towards bottom surface 384 of accumulator piston 336 as pump piston 306 shifts upwards. Further, a force may be transmitted from pump piston 306 to accumulator piston 336 via fuel in compression chamber 308. Therefore, accumulator piston 336 may begin to move away from first stop 339. As shown, pump piston 306 and accumulator piston 336 move in an upward direction in a synchronous manner. Further, fuel from compression chamber 308 may be pushed into region 337 (indicated in third view 760) between bottom surface 384 of accumulator piston 336 and first stop 339. As such, spring 334 coupled to accumulator piston 336 may be compressed during the compression stroke in DI fuel pump 228. Since SACV 312 is in the pass-through state, fuel from region 338 of accumulator 340 may be displaced by the moving accumulator piston 336. Further, the displaced fuel from region 338 may flow through inlet port 328, across SACV 312 to upstream of SACV 312 and into fourth conduit 326. Fuel may further flow from fourth conduit 326 through second conduit 322 into step room 318.

As pump piston 306 moves towards TDC position in third view 760, pressure in the compression chamber 308 may increase until the default pressure is attained. The default pressure, as explained earlier, may be based on the pressure of accumulator 340, which in turn may depend on a force provided by spring 334 acting upon accumulator piston 336. The default pressure may also be a combination of accumulator pressure and outlet pressure of LPP 208.

Thus, pressure in the compression chamber 308 of the DI fuel pump 228 may vary from the default pressure (during at least a portion of the compression stroke) to pressure at the outlet of LPP 208 (during at least a latter part of the suction stroke). In one example, default pressure may be attained in the compression chamber 308 during a latter portion of the compression stroke.

As shown in third view 760, fuel from compression chamber 308 may now at least partially reside in region 337. Region 337 may be bordered by bore 350, pump piston top 305, and bottom surface 384 of accumulator piston 336.

If fuel rail pressure in the DI fuel rail is at or above the default pressure in the compression chamber 308 of DI fuel pump 228, outlet check valve 316 may not open. Third view 760 depicts a situation when fuel in compression chamber may not be pumped out towards DI fuel rail. Accordingly, fuel rail pressure in the DI rail may not increase as fuel may not be delivered into the DI fuel rail. Default pressure in the DI fuel rail may be maintained. Further, fuel may be stored in the accumulator 340, specifically, in region 337, until accumulator piston 336 reaches first stop 339 during a subsequent suction stroke in the DI fuel pump.

Thus, in the default pressure mode of DI pump operation, and when fuel rail pressure in the DI rail is at default pressure, fuel flow to the engine may be substantially reduced (e.g. zero). Further, fuel flow through third conduit 324 may be largely absent. Further still, fuel flow through fourth conduit 326 may oscillate back and forth as pump piston 306 and accumulator piston 336 move synchronously.

Figure 8:
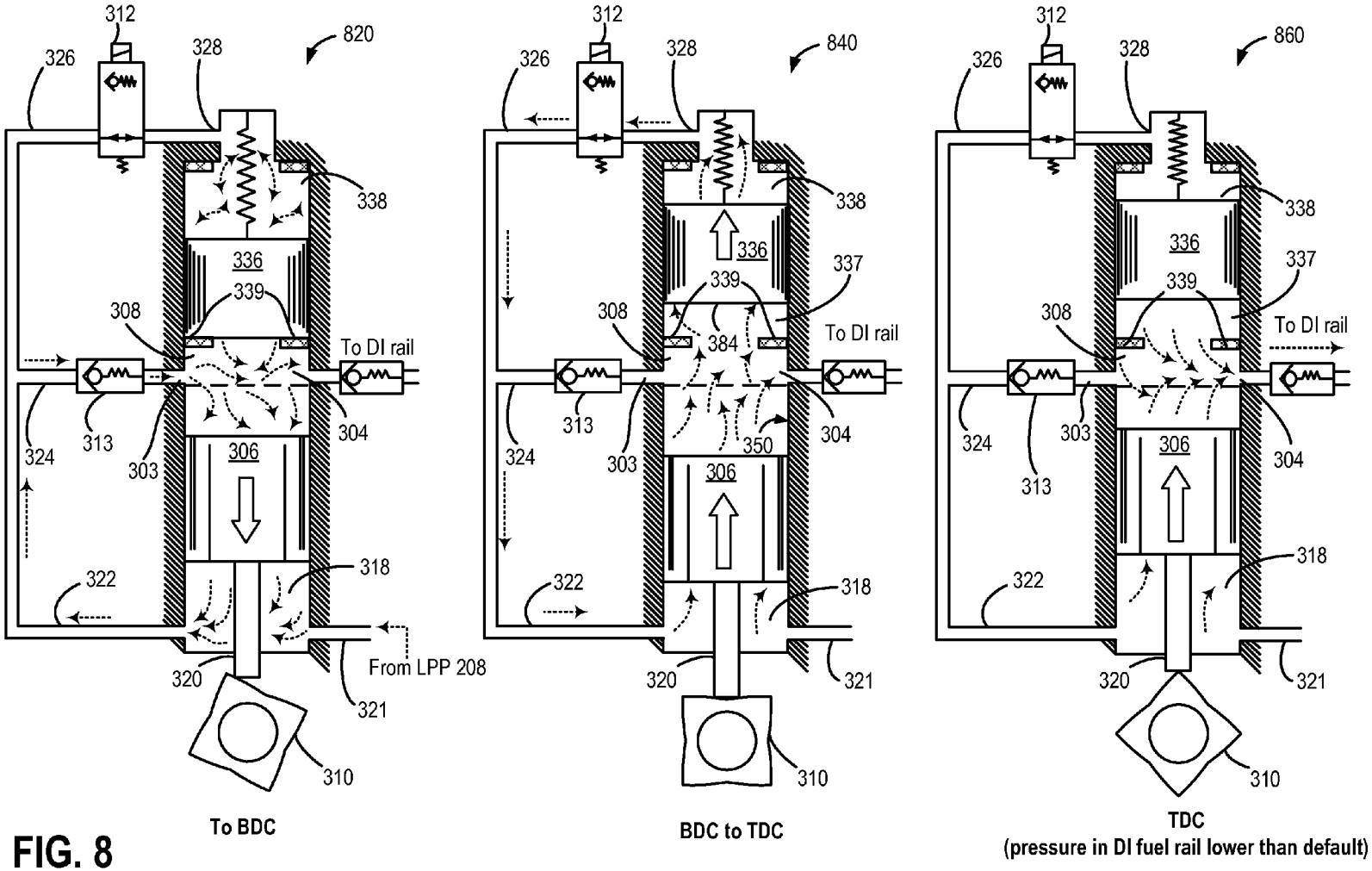
FIG. 8 shows an example operation of the high pressure or direct injection fuel pump of FIG. 3 in default pressure mode when fuel rail pressure in the direct injection fuel rail is below the default pressure.

Turning now to FIG. 8, it shows another example operation of the DI fuel pump 228 in the default pressure mode. Specifically, FIG. 8 shows the operation of the DI fuel pump 228 in default pressure mode when the pressure in DI Fuel rail 250 is lower than the default pressure. As described earlier, the default pressure may be based on accumulator pressure.

FIG. 8 depicts fuel flow in DI fuel pump 228 during three moments of pump piston operation when fuel rail pressure in DI fuel 250 is lower than the default pressure. It will be appreciated that the same operation as depicted in FIG. 8 may be conducted with DI fuel pump 229 of FIG. 4*a* and DI fuel pump 227 of FIG. 4*b* to reduce pump reflux from step room 318.

First view 820 shows fuel flow within DI fuel pump 228 when pump piston 306 is moving downwards towards BDC in a suction stroke. Second view 840 portrays fuel flow within DI fuel pump 228 when pump piston 306 is moving upwards from BDC towards TDC. Third view 860 illustrates fuel flow as pump piston 306 reaches TDC position. Fuel flow is depicted with dashed lines with arrows indicating direction of fuel flow.

Prior to first view 820, a second portion of fuel may flow through SACV 312 into region 338 via inlet port 328 of accumulator 340. As accumulator piston 336 moves down in unison with pump piston 306 during the suction stroke (until first stop 339 is reached), fuel may flow into region 338 through SACV 312. Once the first stop 339 is reached, accumulator piston 336 is obstructed from moving further downwards, and intake flow of fuel via inlet check valve may begin, if demanded. Thus, first view 820 shows accumulator piston 336 arranged at first stop 339 with fuel filling region 338. Once accumulator piston 336 reaches first stop 339, there may be no net flow of fuel through SACV 312. Therefore, no fuel flow is indicated along fourth conduit 326 and through SACV 312 in first view 820.

An occurrence of direct injection during the default pressure mode may result in a decrease in pressure within DI fuel rail 250. For example, direct fuel injection may occur, though at smaller amounts, from the direct injection fuel rail under certain engine conditions. As fuel is delivered into the engine via direct injectors during the default pressure mode of DI fuel pump operation, fuel rail pressure may decrease. In response to this decrease in fuel rail pressure, fuel may be expelled from compression chamber 308 into DI fuel rail 250 during a compression stroke. Accordingly, fuel quantity in the compression chamber may be reduced enabling additional fuel to be drawn in via inlet check valve 313 during the suction stroke in the DI fuel pump as shown in first view 820.

Thus, first view 820 of FIG. 8 illustrates fuel flow into compression chamber 308 via inlet check valve 313. As such, fuel may flow from step room 318, through second conduit 322 and third conduit 324, across inlet check valve 313 into inlet 303 of compression chamber 308. Fuel may be received from step room 318 and/or LPP 208 based on piston rod size.

Second view 840 shows pump piston 306 at BDC beginning an upward motion towards TDC. Fuel in the compression chamber may now be induced towards bottom surface 384 of accumulator piston 336. Further, a force may be transmitted from pump piston 306 to accumulator piston 336 via fuel in compression chamber 308. Therefore, accumulator piston 336 may begin to move away from first stop 339. As shown, pump piston 306 and accumulator piston 336 move in an upward direction in a synchronous manner. Further, fuel from compression chamber 308 may be pushed into region 337 between bottom surface 384 of accumulator piston 336 and first stop 339.

As such, spring 334 coupled to accumulator piston 336 may be compressed during the compression stroke in DI fuel pump 228. Further, spring 334 may exert a force on accumulator piston 336 enabling an increase in pressure of the fuel e.g. fuel in compression chamber 308, region 337, and clearance volume 378. Since SACV 312 is in the pass-through state, fuel from region 338 of accumulator 340 may be displaced by the moving accumulator piston 336. Further, the displaced fuel from region 338 may flow through inlet port 328, across SACV 312 to upstream of SACV 312 and into fourth conduit 326. Fuel may further flow from fourth conduit 326 through second conduit 322 into step room 318.

As pump piston 306 approaches TDC position in third view 860, pressure in the compression chamber 308 may increase until the default pressure is attained. The default pressure, as explained earlier, may be based on the pressure of accumulator 340, which in turn may depend on a force provided by spring 334 acting upon accumulator piston 336. The default pressure may also be a combination of accumulator pressure and outlet pressure of LPP 208. In one example, default pressure may be attained in the compression chamber 308 during a portion of the compression stroke. For example, default pressure may be attained towards a latter portion of the compression stroke. The default pressure may remain until an initial part of a subsequent intake stroke. In another example, default pressure may be achieved from about halfway through the compression stroke until a first half of the subsequent suction stroke.

If fuel rail pressure in DI fuel rail 250 is lower than the default pressure in the compression chamber 308, fuel may be forced into DI fuel rail 250 as shown in third view 860. Fuel may flow from compression chamber 308 through forward flow outlet check valve 316 into DI fuel rail 250 enabling an increase in fuel rail pressure in DI fuel rail 250 to default. As such, fuel may also exit region 337 towards forward flow outlet check valve 316. Though not shown in third view 860, accumulator piston 336 may, in one example, shift towards first stop 339 as fuel flows out of region 337. In another example, as pump piston 306 completes its compression stroke, accumulator piston 336 may not rise as expected if fuel flows out of region 337 and compression chamber 308 into DI fuel rail 250.

Thus, an example system may comprise a direct injection fuel pump including a piston and a compression chamber, the piston driven by a cam and reciprocating within a bore, a high pressure fuel rail fluidically coupled to the direct injection fuel pump, an accumulator positioned within the bore of the direct injection fuel pump in a coaxial manner fluidically communicating with the compression chamber, a plunger of the accumulator arranged within the bore to move axially between a first stop and a second stop, a spring coupled to the plunger, an inlet check valve positioned at an inlet of the compression chamber, a solenoid activated check valve positioned upstream of the accumulator, an inlet of the solenoid activated check valve fluidically coupled to a low pressure pump, and an outlet of the solenoid activated check valve fluidically communicating with the accumulator. During a first condition in the example system, pressure in the compression chamber of the direct injection fuel pump and the high pressure fuel rail may be regulated via axial motion of the accumulator. Further, during a second condition, pressure within the compression chamber and the high pressure fuel rail may be regulated via the solenoid activated check valve. The first condition may include de-energizing the solenoid activated check valve (to function in a pass-through state), and the second condition may include activating and energizing the solenoid activated check valve as desired.

Figure 9:
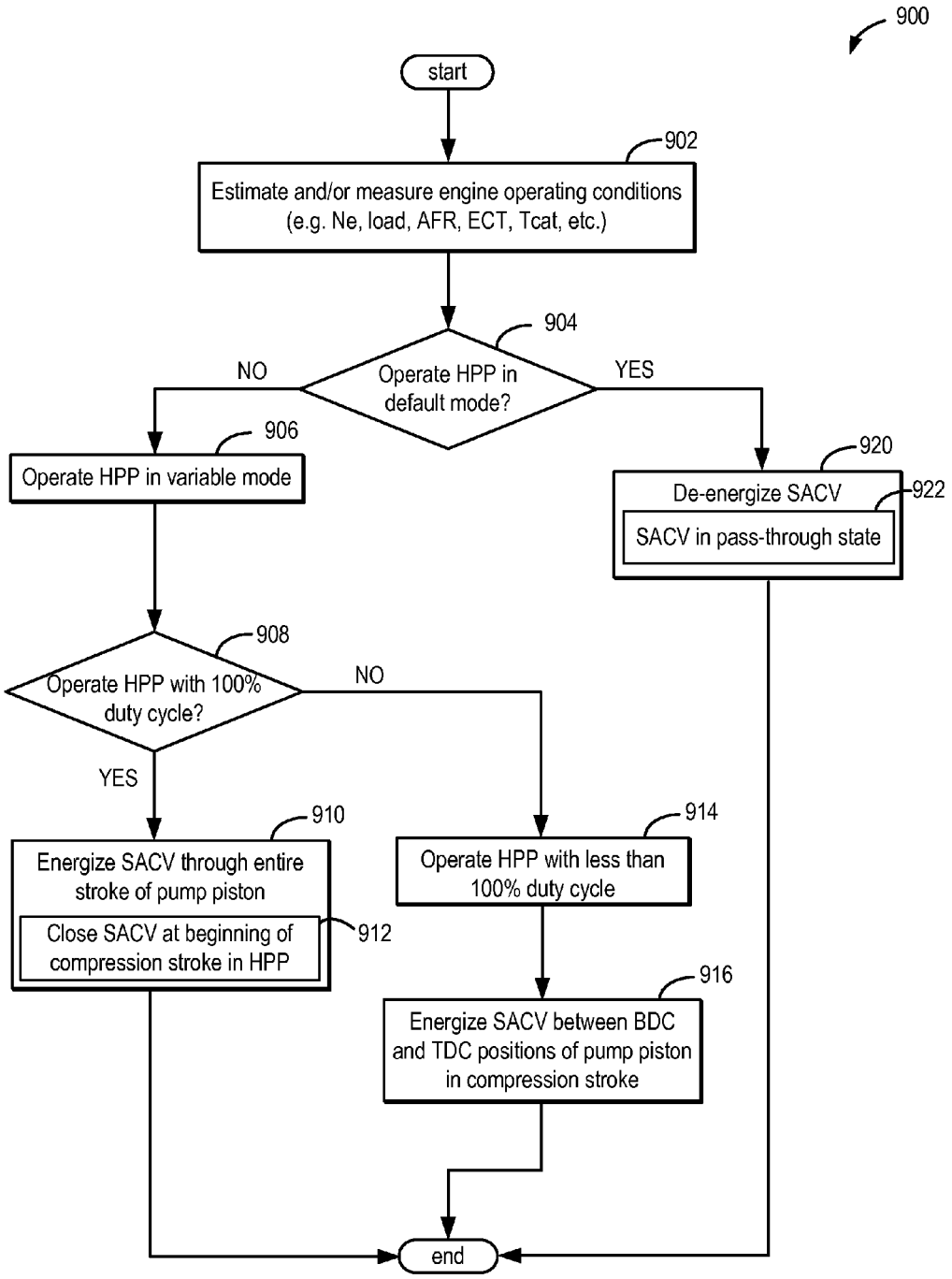
FIG. 9 is a high level flow chart illustrating an example control algorithm for a solenoid activated check valve in the direct injection fuel pump.

Turning now to FIG. 9, it depicts an example routine 900 illustrating an example control of DI fuel pump operation in the variable pressure mode and in the default pressure mode. At 902, engine operating conditions may be estimated and/or measured. For example, engine conditions such as engine speed, engine fuel demand, boost, driver demanded torque, engine temperature, air charge, etc. may be determined.

At 904, routine 900 may determine if the HPP (e.g. DI fuel pump 228) can be operated in the default pressure mode. The HPP may be operated in default pressure mode, in one example, if the engine is idling. In another example, the HPP may function in default pressure mode if the vehicle is decelerating. If it is determined that the DI fuel pump can be operated in default pressure mode, routine 900 progresses to 920 to deactivate and de-energize the solenoid activated check valve (such as SACV 312 of DI pump 228). To elaborate, the solenoid within the SACV may be de-energized to a pass-through state such that fuel may flow through the SACV both upstream from and downstream of SACV. Herein, as explained earlier, a default pressure of DI fuel pump 228 may be achieved due to the presence of accumulator 340 within DI fuel pump 228.

If, however, it is determined at 904 that the HPP may not be operated in default pressure mode, routine 900 continues to 906 to operate the HPP in variable pressure mode. The variable pressure mode of HPP operation may be used during non-idling conditions, in one example. In another example, the variable pressure mode may be used when torque demand is greater, such as during acceleration of a vehicle. As mentioned earlier, variable pressure mode may include controlling HPP operation electronically by actuating and energizing the solenoid activated check valve, and regulating fuel pressure continuously.

Next, at 908, routine 900 may determine if current torque demand (and fuel demand) includes a demand for full pump strokes. Full pump strokes may include operating the DI fuel pump at 100% duty cycle wherein a substantially large portion of fuel is delivered to the DI fuel rail. An example 100% duty cycle operation of the DI pump is depicted in FIG. 5.

If it is confirmed that full pump strokes (e.g., 100% duty cycle) are desired, routine 900 continues to 910, where the SACV may be energized for an entire stroke of the pump. As such, the SACV may be energized (and closed to function as a check valve) through an entire compression stroke. Thus, at 912, the SACV may be energized and closed at a beginning of a compression stroke. Further, the SACV may be closed at the beginning of each subsequent compression stroke until pump operation is modified. For example, pump operation may be modified when a reduced pump stroke may be commanded or in another example, pump operation may be changed to default pressure mode.

If, on the other hand, it is determined at 908 that full pump strokes are (or 100% duty cycle operation is) not desired, routine 900 progresses to 914 to operate the DI pump in a reduced pump stroke or at less than 100% duty cycle. Next, at 916, the controller may energize and close the SACV at a time between BDC position and TDC position of the pump piston in the compression stroke. For example, the DI pump may be operated with a 20% duty cycle wherein the SACV is energized to close when 80% of the compression stroke is complete to pump about 20% volume of the DI pump. In another example, the DI pump may be operated with a 60% duty cycle, wherein the SACV may be closed when 40% of the compression stroke is complete. Herein, 60% of the DI pump volume may be pumped into the DI fuel rail. An example of a reduced pump stroke or a less than 100% duty cycle operation (also termed, reduced duty cycle operation) of the HP pump is previously described in reference to FIG. 6.

It will be noted that a controller may command routine 900 which may be stored in non-transitory memory of the controller, such as controller 12.

Figure 10:
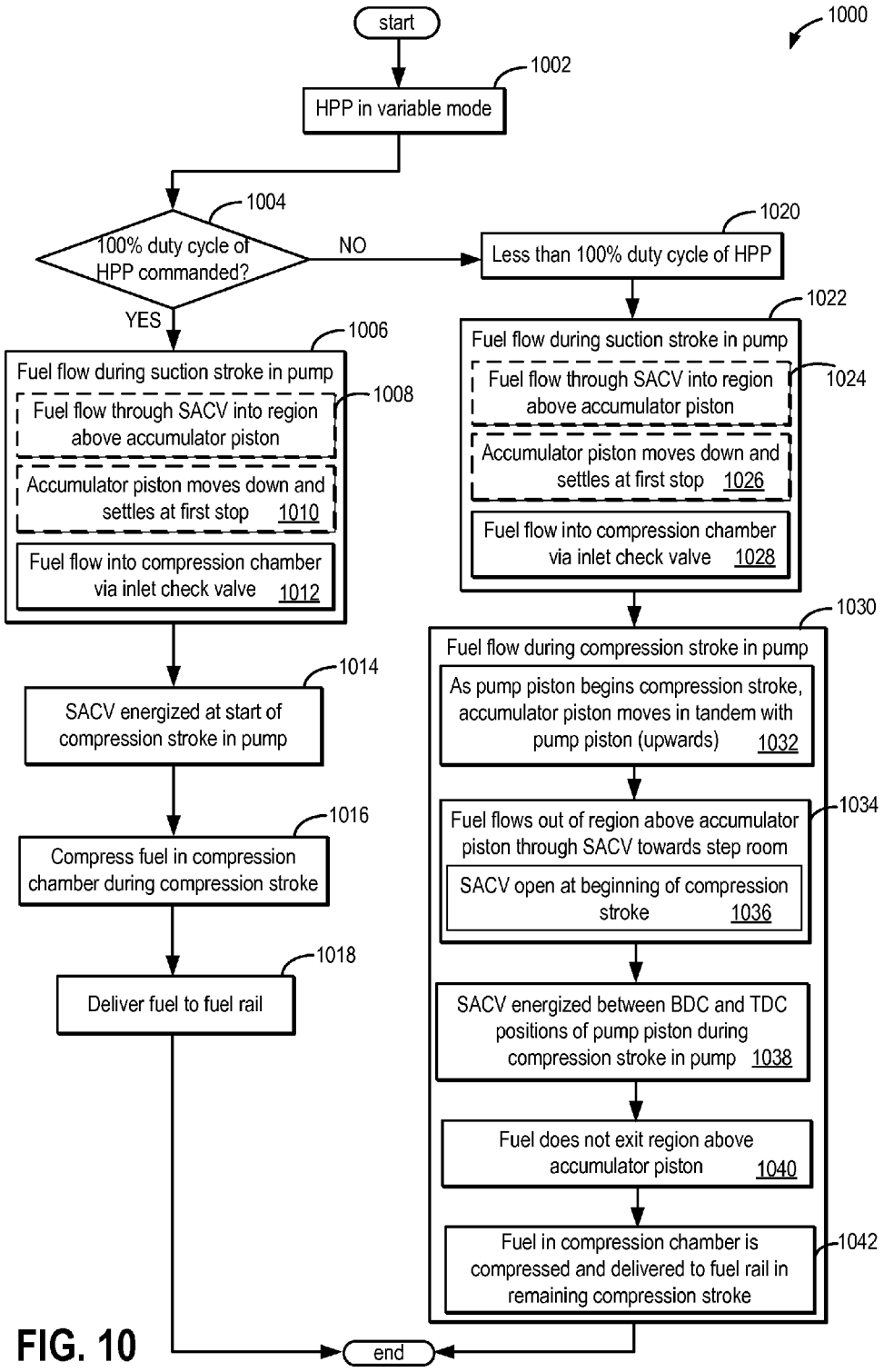
FIG. 10 is an example flow chart illustrating fuel flow during operation of the high pressure or direct injection fuel pump of FIG. 3 in variable pressure mode in accordance with the present disclosure.
Figure 11:
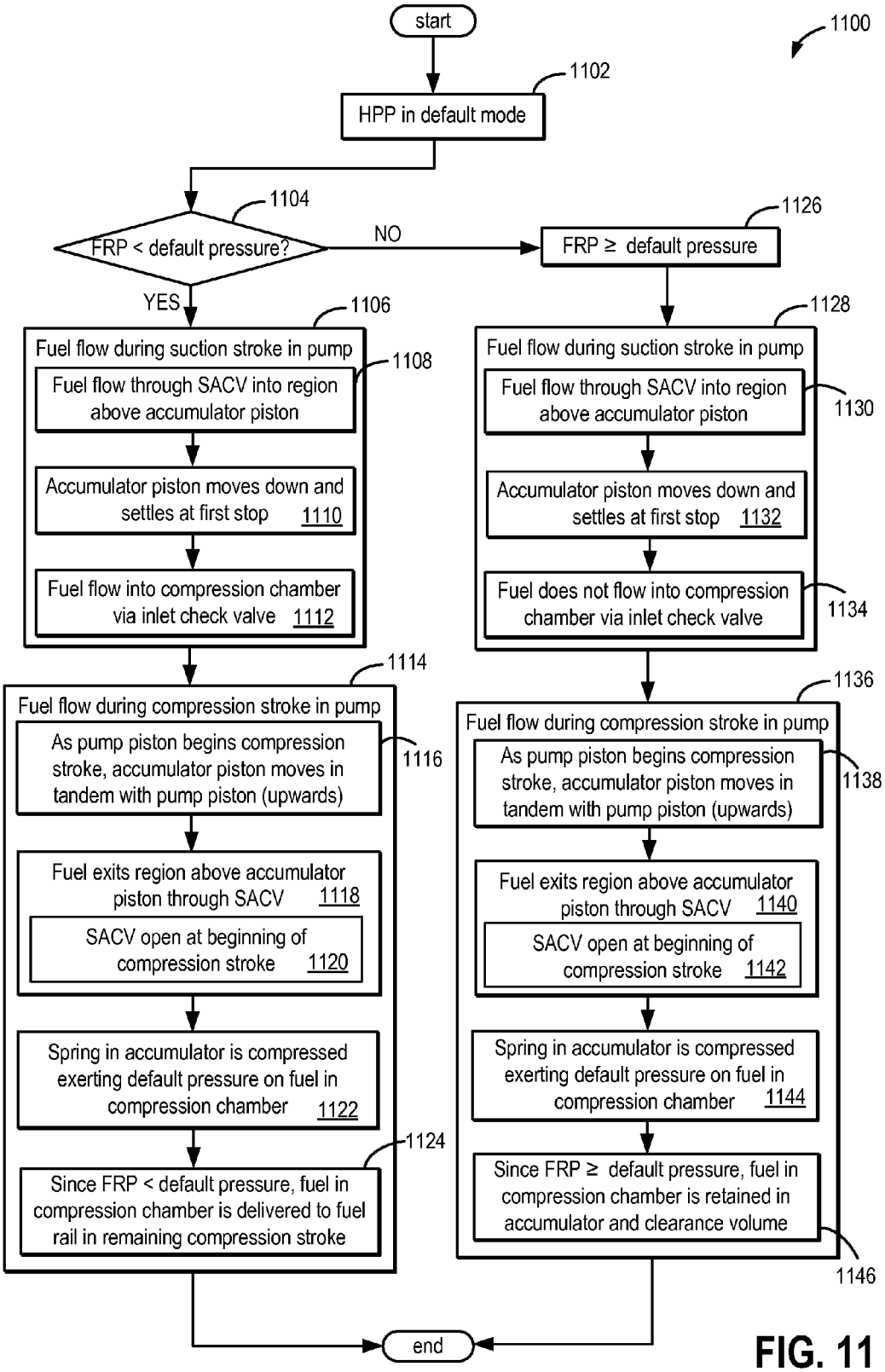
FIG. 11 is an example flow chart illustrating fuel flow during an operation of the high pressure or direct injection fuel pump of FIG. 3 in default pressure mode in accordance with the present disclosure.

Turning now to FIGS. 10 and 11, they portray routines 1000 and 1100, respectively, illustrating example fuel flow in the different modes of DI fuel pump operation. Specifically, routine 1000 depicts example fuel flow in the DI fuel pump during a variable pressure mode, while routine 1100 presents example fuel flow in the DI fuel pump during a default pressure mode. It will be noted that the controller may not command nor perform routines 1000 and 1100 shown respectively in FIG. 10 and FIG. 11. As such, fuel flow may occur due to hardware within the DI fuel pump.

At 1002, it may be determined that the DI fuel pump, such as DI fuel pump 228, is operating in the variable pressure mode. Fuel flow during a 100% duty cycle of the DI pump may differ from fuel flow during a less than 100% duty cycle of the DI pump. Accordingly each example is illustrated. At 1004, routine 1000 may confirm if a 100% duty cycle (or full pump stroke) is commanded to the DI fuel pump. If yes, routine 1000 continues to 1006 where a suction stroke may be occurring in the DI fuel pump. The suction stroke may include a shift in position of the pump piston from TDC position to BDC position.

As the pump piston (such as pump piston 306 of FIG. 3) moves downwards, a pressure in the compression chamber (such as compression chamber 308 of DI fuel pump 228) reduces. Further, any fuel present in region 337 below an accumulator piston (such as accumulator piston 336 of accumulator 340) may be drawn into the compression chamber. It will be noted that if fuel is present in region 337, the accumulator piston may initially be at a position between a first stop (such as first stop 339 of accumulator 340) and a second stop (such as second stop 335 of accumulator 340). Further still, the accumulator piston may travel downwards as fuel in region 337 flows downwards into an increasing volume of the compression chamber.

The movement of the accumulator piston enables fuel to flow through a solenoid activated check valve (such as SACV 312 of DI fuel pump 228) at 1008 of routine 1000 into a region above the accumulator piston, such as region 338 above accumulator piston 336. Next, at 1010, the accumulator piston travels downwards until its downward axial motion is impeded by the first stop. It will be noted that 1008 and 1010 are depicted with dashed lines indicating optional fuel flows. These optional fuel flows may not occur when the accumulator piston is at rest at the first stop when the suction stroke begins.

Once the accumulator piston is at the first stop, fuel may flow into the compression chamber via an inlet check valve, such as inlet check valve 313 of DI fuel pump 228, at 1012. Fuel may be drawn via inlet check valve after the accumulator piston is held stationary at the first stop throughout the remainder of the suction stroke.

Since the DI fuel pump is operating with a 100% duty cycle, at 1014, the SACV may be energized to close at the start of a compression stroke by the pump piston. Thus, fuel flow out of region 338 (above accumulator piston 336) through SACV 312 towards fourth conduit 326 in DI fuel pump 228 may be impeded. At 1016, as the pump piston moves upwards towards the compression chamber, fuel pressure may increase substantially. Once pressure in the compression chamber increases to higher than a pressure in the DI fuel rail, fuel may be delivered to the DI fuel rail at 1018. As such, a substantial amount (e.g., a maximum) of fuel may be delivered to the DI fuel rail during 100% duty cycle operation of the DI fuel pump.

Returning to 1004, if the DI fuel pump is not operating at 100% duty cycle in the variable pressure mode, at 1020, it may be determined that the DI fuel pump is operating at less than 100% duty cycle (or in a reduced pump stroke). Routine 1000 continues to 1022 at a beginning of a suction stroke in the DI pump. As the pump piston moves downwards, a pressure in the compression chamber reduces. Further, any fuel present in region 337 below the accumulator piston may be drawn into the compression chamber. It will be noted that if fuel is present in region 337, the accumulator piston may initially be at a position between the first stop and the second stop. Further still, the accumulator piston may travel downwards as fuel in region 337 flows downwards into an increasing volume of the compression chamber.

As the accumulator piston shifts towards first stop 339, fuel may flow through the SACV into the region (such as, region 338) above the accumulator piston at 1024. This flow into region 338 may further enable a downward motion of the accumulator piston towards the first stop at 1026. It will be noted that 1024 and 1026 are depicted with dashed lines indicating optional fuel flow processes. These optional fuel flows may not occur if the accumulator piston is at rest at the first stop when the suction stroke begins.

Once the accumulator piston is at the first stop at 1026, fuel may flow into the compression chamber via an inlet check valve, such as inlet check valve 313 of DI fuel pump 228, at 1028. Fuel may be drawn via inlet check valve after the accumulator piston is held stationary at the first stop throughout the remainder of the suction stroke.

Since the DI fuel pump is operating with a reduced pump stroke or a less than 100% duty cycle, the SACV may not be energized to close until the pump piston is between the BDC position and the TDC position during the subsequent compression stroke. At 1030, a subsequent compression stroke (relative to suction stroke at 1022) may commence and occur in the DI fuel pump. At 1032, as the pump piston moves upwards toward the compression chamber from BDC position, fuel in the compression chamber may impel an upward motion of the accumulator piston. Thus, the accumulator piston moves in tandem with the pump piston. The accumulator piston may shift upwards because the SACV continues to be open allowing fuel to flow through towards fourth conduit 326 (in FIG. 3). As the accumulator piston travels upward towards the second stop, fuel may be displaced from the region above the accumulator piston, at 1034, and may travel through SACV towards the step room of the DI fuel pump. The SACV may thus be open, in a pass-through state, at 1036, at the beginning of the compression stroke.

At a desired moment based on the demanded duty cycle, the SACV may be energized between BDC and TDC positions of the pump piston, at 1038, during the compression stroke. Next, at 1040, fuel may not be allowed to exit the region above the accumulator piston, and the accumulator piston may accordingly be rendered stationary. At 1042, fuel in the compression chamber may be compressed to increase pressure in the compression chamber. Further, as pressure in the compression chamber exceeds the pressure in the DI fuel rail, fuel may exit the compression chamber towards the DI fuel rail via an outlet check valve, such as forward flow outlet check valve 316 of FIG. 3.

Turning now to FIG. 11, it shows routine 1100 illustrating an example fuel flow in the DI fuel pump during a default pressure mode. It will be noted herein that the controller may not command nor perform routine 1100. As such, fuel flow may occur due to hardware within the DI fuel pump.

At 1102, it may be determined that the DI fuel pump, such as DI fuel pump 228, is operating in the default pressure mode. As described earlier, the default pressure mode operation of the DI fuel pump includes deactivating and de-energizing the SACV throughout pump operation. Thus, fuel flow may occur to and fro through the SACV, both upstream and downstream of the SACV.

Next, at 1104, it may be confirmed if fuel rail pressure (FRP) in the DI fuel rail is lower than the default pressure of the DI fuel pump. Direct injection during the default pressure mode may result in a decrease in pressure within the DI fuel rail. As fuel is delivered into the engine via direct injectors during the default pressure mode of DI fuel pump operation, FRP may decrease. In response to this decrease in FRP, fuel may be expelled from the compression chamber of the DI pump into the DI fuel rail during a compression stroke. Accordingly, fuel quantity in the compression chamber may be reduced enabling additional fuel to be drawn in via the inlet check valve during the suction stroke in the DI fuel pump as shown in FIG. 8.

If FRP is lower than the default pressure or was previously lower than the FRP, routine 1100 continues to 1106 wherein a suction stroke may be beginning in the DI fuel pump. As the pump piston of the DI fuel pump moves downwards, a pressure in the compression chamber reduces. Further, any fuel present in region 337 below an accumulator piston may be drawn into the compression chamber. It will be noted that if fuel is present in region 337, the accumulator piston may initially be at a position between a first stop (such as first stop 339 of accumulator 340) and a second stop (such as second stop 335 of accumulator 340). As such, fuel may be stored in the accumulator. Further still, the accumulator piston may travel downwards as fuel in region 337 flows downwards into an increasing volume of the compression chamber.

The movement of the accumulator piston enables fuel to flow through a solenoid activated check valve (such as SACV 312 of DI fuel pump 228) at 1108 of routine 1100 into the region above the accumulator piston. Next, at 1110, the accumulator piston travels downwards until its downward axial motion is impeded by the first stop. Once the accumulator piston rests at the first stop, at 1112, fuel may flow into the compression chamber via the inlet check valve. As such, fuel may flow into the compression chamber from the inlet check valve through a remainder of the suction stroke (after accumulator piston reaches the first stop).

Next, at 1114, a subsequent compression stroke may occur, which includes the pump piston moving upwards from BDC to TDC. The accumulator piston may move upwards in unison with the pump piston at 1116. The shift of the accumulator piston in the upward direction towards the second stop impels fuel in the region above the accumulator piston to flow out through the SACV at 1118. As such, at 1120, the SACV may be open during the compression stroke. As the accumulator piston moves upwards, a spring of the accumulator (such as spring 334 of DI pump 228 in FIG. 3) may be compressed and pressure in the compression chamber of the DI pump may increase to the default pressure at 1122. The default pressure may be based on a force constant of the spring. As FRP is lower than the default pressure, fuel flows out of the compression chamber and the accumulator at 1124 once default pressure is attained in the DI fuel pump. Thus, fuel flow into the DI fuel rail may increase FRP to the default pressure.

It will be noted that the accumulator piston motion matches the motion of the pump piston. To elaborate, a direction of motion of the accumulator piston may substantially match a direction of motion of the pump piston when the DI fuel pump operates in the default pressure mode with the SACV in the pass-through state. As the pump piston moves downwards toward BDC in the suction stroke, the accumulator piston may move downwards until it comes to a rest at the first stop. During the compression stroke, when the pump piston moves upwards toward TDC the accumulator piston also moves upward towards the second stop.

If, at 1104, it is determined that FRP is not lower than the default pressure, routine 1100 continues to 1126 to determine that FRP is greater than or equal to the default pressure. Further, at 1128, a suction stroke may commence in the DI fuel pump. As the pump piston of the DI fuel pump moves downwards, a pressure in the compression chamber reduces. Further, any fuel present in region 337 below an accumulator piston at the end of the previous compression stroke may be drawn into the compression chamber. As such, fuel may be stored in the accumulator at the end of a preceding compression stroke. Further still, the accumulator piston may travel downwards as fuel in region 337 flows downwards into an increasing volume of the compression chamber.

The movement of the accumulator piston enables fuel to flow through a solenoid activated check valve (such as SACV 312 of DI fuel pump 228) at 1130 of routine 1100 into the region above the accumulator piston. Next, at 1132, the accumulator piston travels downwards until its downward axial motion is impeded by the first stop. Once the accumulator piston rests at the first stop though, at 1134, fuel may not flow into the compression chamber via the inlet check valve. Since FRP is higher than (or equal to) the default pressure, no fuel outflow may occur from the compression chamber towards the DI fuel rail. Further, fuel may be stored in the accumulator. Accordingly, there may be no fuel intake from the inlet check valve. In one example though, a minimal amount of fuel may leak into the compression chamber via the inlet check valve.

Next, at 1136, a compression stroke subsequent to the suction stroke at 1128 may occur, which includes the pump piston moving upwards from BDC to TDC. The accumulator piston may move upwards in unison with the pump piston at 1138. The shift of the accumulator piston in the upward direction towards the second stop impels fuel in the region above the accumulator piston to flow out through the SACV at 1140. As such, at 1142, the SACV may be open during the compression stroke. As the accumulator piston moves upwards, the spring of the accumulator may be compressed and pressure in the compression chamber of the DI pump may increase to the default pressure at 1144. As FRP is higher than (or substantially equivalent to) the default pressure, fuel may not exit the compression chamber. At 1146, fuel may be retained in the accumulator and the clearance volume of the compression chamber of the DI fuel pump. Accordingly, fuel may be stored in the accumulator for at least a portion of the compression stroke.

In this manner, a fuel system may include a direct injection (DI) fuel pump that can be operated in a mechanical or default pressure mode without increasing a temperature of fuel. Since the default pressure is maintained by an accumulator, an upstream pressure relief valve may be eliminated, and fuel heating due to repeated flowing through the pressure relief valve may be reduced. The accumulator may be arranged coaxially within a bore of the DI fuel pump such that the accumulator is located towards a first end of a compression chamber of the DI fuel pump. The accumulator may include a spring coupled to an accumulator piston. A piston of the DI fuel pump or a pump piston may be positioned towards a second end of the compression chamber of the DI fuel pump. Thus, the compression chamber may be bounded by the bore (specifically, walls of the bore), the accumulator (specifically, a piston or plunger of the accumulator), and the pump piston. As such, the accumulator piston and the pump piston may be located on opposite sides of the compression chamber. Further, the accumulator and the pump piston may be positioned within the same, common bore of the DI fuel pump. Thus, the accumulator and the pump piston share the bore of the DI fuel pump. It will also be appreciated that the accumulator piston may move axially within the bore between a first stop (positioned towards the compression chamber) and a second stop (located towards an inlet of the accumulator away from the compression chamber).

The DI fuel pump may also include a solenoid actuated check valve or solenoid spill valve which may be positioned upstream of the accumulator. Further, the solenoid actuated check valve may be fluidically coupled to the accumulator. The axial motion of the accumulator piston between the first stop and the second stop may be substantially regulated by the solenoid actuated check valve (SACV) coupled upstream of an inlet to the accumulator. Specifically, the axial motion of the accumulator piston may be regulated by fuel flow through the SACV. A motion of the pump piston may also affect the motion of the accumulator piston. A region (of variable volume) above the accumulator piston may receive fuel via the solenoid actuated check valve. The compression chamber of the DI fuel pump may receive fuel primarily via an inlet check valve.

When the DI fuel pump is operating in a variable pressure mode, the solenoid actuated check valve may be activated and energized to meter an amount of fuel flowing through the solenoid actuated check valve. Further, when the DI fuel pump is operating at full pump strokes (e.g. 100% duty cycle), the SACV may be energized to a closed position at a beginning of a compression stroke so that the accumulator piston remains substantially fixed at the first stop during the compression stroke. Conversely, if the DI fuel pump is operating at reduced pump strokes (e.g. less than 100% duty cycle), the accumulator piston may be rendered stationary at a position between the first stop and the second stop based on when the SACV is energized during a compression stroke. Fuel in the compression chamber may be compressed by the pump piston against the accumulator piston and the bore, and may be delivered to a high pressure fuel rail fluidically coupled to the DI fuel pump. This added fuel into the high pressure fuel rail enables an increase in fuel rail pressure. Thus, pressure in the high pressure fuel rail may be regulated by adjusting a duty cycle of the solenoid actuated check valve in the variable pressure mode.

When the DI fuel pump is operating in a default pressure mode, such as engine operation during lower engine loads, the solenoid actuated check valve may be de-activated and de-energized to function in a pass-through state. Herein, the accumulator piston position may not be fixed during the compression strokes; the accumulator piston may be capable of axial motion along the bore between the first stop and the second stop in the accumulator.

As fuel in the compression chamber is compressed in a compression stroke of the pump piston, displaced fuel may be forced into the accumulator. Specifically, fuel may be forced into a region below the accumulator piston, e.g. between the first stop and a base (or bottom surface) of the accumulator piston during the compression stroke. Thus, fuel may be stored in the accumulator during at least a part of the compression stroke. Further still, the fuel may remain in the accumulator during the compression stroke and may not be delivered into the high pressure fuel rail as long as fuel pressure in the high pressure fuel rail is at or higher than the default pressure. Thus, fuel rail pressure in the high pressure fuel rail may not increase. It will be noted that the default pressure may be a result of spring force acting of the accumulator piston.

If a fuel injection event causes a decrease in fuel pressure in the high pressure fuel rail, the accumulator may supply fuel to the high pressure fuel rail during the compression stroke to maintain default pressure in the high pressure fuel rail. Thus, pressure in the high pressure fuel rail may be maintained by the accumulator within the DI fuel pump. As such, pressure in the compression chamber may reduce to that at an outlet of a lift pump towards an end of a suction stroke in the DI fuel pump during default mode operation.

In this manner, an example method may comprise, when a solenoid activated check valve positioned upstream of an accumulator is de-energized (e.g., deactivated) and commanded to a pass-through state, regulating a pressure in each of a compression chamber of a direct injection fuel pump and a fuel rail via axial motion of the accumulator, the accumulator positioned coaxially within a bore of the direct injection fuel pump. The accumulator may fluidically communicate with the compression chamber of the direct injection fuel pump. Further, the accumulator may store fuel for a portion of a compression stroke in the direct injection fuel pump. As such, the pressure in the compression chamber of the direct injection fuel pump may be regulated to provide a differential pressure between a top and a bottom of a piston of the direct injection fuel pump (e.g., pump piston 306 of FIG. 3) during the compression stroke in the direct injection fuel pump. The accumulator may include a spring coupled to a piston, the piston disposed within the bore of the direct injection fuel pump to move axially between a lower stop (first stop 339 of FIG. 3) and a higher stop (second stop 335 of FIG. 3). The method may further comprise, when the solenoid activated check valve is energized, regulating the pressure in the compression chamber of the direct injection fuel pump and the fuel rail via the solenoid activated check valve. In this way, a direct injection fuel pump may be operated in a default pressure or mechanical mode without increasing fuel temperature. Further, by maintaining the default pressure in the compression chamber of the DI fuel pump via the accumulator, lubrication of the DI fuel pump may be continued enabling a reduction in degradation of the DI fuel pump. By incorporating the accumulator within the bore of the DI fuel pump, fuel may be stored in the accumulator during the default pressure mode without undergoing an increase in fuel temperature. As such, fuel heating may be reduced and a likelihood of vapor formation may also be reduced. Overall, DI fuel pump operation may be enhanced while extending an operating life of the DI fuel pump.

In another representation, a system for a direct injection fuel pump may comprise an accumulator positioned coaxially within a bore of the direct injection fuel pump, the accumulator arranged downstream from a solenoid activated check valve. The accumulator may include a spring and a piston wherein the spring is coupled to the piston. The piston of the accumulator may be positioned between a first stop and a second stop, the first stop being towards a compression chamber of the direct injection fuel pump and the second stop being away from the compression chamber of the direct injection fuel pump. The piston of the accumulator may share the bore of the direct injection fuel pump with a pump piston, the pump piston being driven by a cam. The piston of the accumulator and the pump piston may be arranged opposite from each other. The piston of the accumulator may be positioned at a first end of the compression chamber and the pump piston may be positioned at a second end of the compression chamber, the first end and the second end being opposite from each other. The accumulator may be fluidically coupled to the compression chamber. Further still, the accumulator may store fuel during at least a portion of a compression stroke in the DI pump when the DI pump is operated in default pressure mode. Additionally, the accumulator may not store fuel when a full pump stroke is commanded to the direct injection fuel pump in variable pressure mode, the full pump stroke including energizing the solenoid activated check valve at a beginning of a compression stroke in the direct injection fuel pump.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an accumulator having an accumulator piston positioned within a bore of a direct injection fuel pump in a coaxial manner opposite a pump piston with a compression chamber defined between the accumulator piston and the pump piston, and a solenoid activated check valve directly coupled to a volume of the accumulator with the accumulator piston separating the compression chamber from the volume of the accumulator.

2. The system of claim 1, wherein the accumulator is arranged above the compression chamber and a step room is arranged below the compression chamber within the bore of the direct injection fuel pump, the step room separated from the compression chamber by the pump piston, the step room fluidically coupled to a fuel tank, and the step room directly coupled to the solenoid activated check valve.

3. The system of claim 2, wherein the compression chamber of the direct injection fuel pump receives fuel from the step room via an inlet check valve coupled at an inlet of the compression chamber and wherein fuel exits the compression chamber through an outlet valve, the outlet valve fluidically coupled to a high pressure fuel rail, the inlet check valve directly coupled to the solenoid activated check valve.

4. The system of claim 3, wherein the accumulator includes a spring coupled to the accumulator piston, the accumulator piston capable of moving axially in the bore of the direct injection fuel pump between a first stop and a second stop, the first stop being closer to a bottom surface of the accumulator piston and the second stop being closer to a top surface of the accumulator piston.

5. The system of claim 4, wherein the first stop is located towards the compression chamber in the direct injection fuel pump, and the second stop is located away from the compression chamber inside the volume of the accumulator of the direct injection fuel pump.

6. The system of claim 5, wherein a motion of the accumulator piston is regulated by flow of fuel from a low pressure fuel pump through the solenoid activated check valve directly to the volume of the accumulator.

7. The system of claim 6, wherein when the solenoid activated check valve is de-energized and in a pass-through mode to enable fuel flow directly in or out of the volume of the accumulator, a direction of the motion of the accumulator piston is substantially in unison with a direction of a motion of the pump piston in the direct injection fuel pump.

8. The system of claim 7, wherein the pump piston is arranged on a first end within the bore and the accumulator piston is arranged across a second end within the bore of the direct injection fuel pump, the first end being opposite the second end.

9. The system of claim 8, wherein during a default pressure mode of operation of the direct injection fuel pump, the accumulator stores fuel at a given pressure during a portion of a compression stroke in the direct injection fuel pump, the given pressure based on a force constant of the spring of the accumulator.

10. The system of claim 9, wherein the direct injection fuel pump includes a piston stem coupled to the pump piston, the piston stem having an outside diameter substantially equal in size to an outside diameter of the pump piston.

11. The system of claim 9, wherein the direct injection fuel pump includes a piston stem coupled to the pump piston, the piston stem having an outside diameter substantially half of an outside diameter of the pump piston.

12. A method, comprising:

when a solenoid activated check valve positioned upstream of an accumulator and directly coupled to a volume of the accumulator is de-energized and commanded to a pass-through state in a default pressure mode of operation:

regulating a pressure in a compression chamber of a direct injection fuel pump via axial motion of a piston of the accumulator, and via axial motion of a pump piston within a bore of the direct injection fuel pump, defining a compression chamber volume between the pump piston and the piston of the accumulator, the piston of the accumulator separating the volume of the accumulator from the compression chamber volume.

13. The method of claim 12, wherein the accumulator fluidically communicates with the compression chamber of the direct injection fuel pump, and wherein the accumulator stores fuel for a portion of a compression stroke in the direct injection fuel pump.

14. The method of claim 13, wherein the pressure in the compression chamber of the direct injection fuel pump is regulated to provide a differential pressure between a top and a bottom of a piston of the direct injection fuel pump during a compression stroke in the direct injection fuel pump.

15. The method of claim 14, wherein the accumulator includes a spring coupled to the piston, the piston disposed within the bore of the direct injection fuel pump to move axially between a first stop and a second stop.

16. The method of claim 15, further comprising, when the solenoid activated check valve is energized in a variable pressure mode of operation, regulating the pressure in the compression chamber of the direct injection fuel pump via the solenoid activated check valve.

17. A system, comprising:

a direct injection fuel pump including a compression chamber and a piston, the piston driven by a cam and reciprocating within a bore;

a high pressure fuel rail fluidically coupled to the direct injection fuel pump;

an accumulator positioned within the bore of the direct injection fuel pump in a coaxial manner fluidically communicating with the compression chamber;

a plunger of the accumulator arranged within the bore to move axially between a first stop and a second stop, the plunger of the accumulator opposite the piston within the bore, the plunger separating a volume of the accumulator from the compression chamber;

a spring coupled to the plunger;

an inlet check valve positioned at an inlet of the compression chamber;

a solenoid activated check valve directly coupled to the volume of the accumulator;

an inlet of the solenoid activated check valve fluidically coupled to a low pressure pump; and an outlet of the solenoid activated check valve fluidically communicating directly with the volume of the accumulator.

18. The system of claim 17, wherein during a first condition, pressure in the compression chamber of the direct injection fuel pump and the high pressure fuel rail is regulated via axial motion of the accumulator, and wherein during a second condition, pressure within the compression chamber and the high pressure fuel rail is regulated via the solenoid activated check valve.

19. The system of claim 18, wherein the first condition includes deactivating and de-energizing the solenoid activated check valve, and wherein the second condition includes activating the solenoid activated check valve.

* * * * *